US009541853B2

(12) United States Patent
Minagawa et al.

(10) Patent No.: US 9,541,853 B2
(45) Date of Patent: Jan. 10, 2017

(54) MAGNETIC CARRIER, TWO-COMPONENT DEVELOPER, REPLENISHING DEVELOPER, AND IMAGE FORMING METHOD

(71) Applicant: CANON KABUSHIKI KAISHA, Tokyo (JP)

(72) Inventors: Hironori Minagawa, Moriya (JP); Wakashi Iida, Toride (JP); Nobuyoshi Sugahara, Tokyo (JP); Minoru Yoshifuku, Iga (JP); Yuto Onozaki, Shimotsuma (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 14/290,738

(22) Filed: May 29, 2014

(65) Prior Publication Data

US 2014/0356781 A1 Dec. 4, 2014

(30) Foreign Application Priority Data

May 30, 2013 (JP) ..... 2013-113776

(51) Int. Cl.
*G03G 9/107* (2006.01)
*G03G 9/113* (2006.01)

(52) U.S. Cl.
CPC ..... *G03G 9/1131* (2013.01); *G03G 9/107* (2013.01); *G03G 9/1075* (2013.01)

(58) Field of Classification Search
CPC .... G03G 9/1131; G03G 9/1075; G03G 9/107; G03G 9/113; G03G 13/08; G03G 13/09
USPC ..... 430/111.32, 111.33, 122.4, 122.2
See application file for complete search history.

(56) References Cited

U.S. PATENT DOCUMENTS 8,137,886 B2 * 3/2012 Baba ..... G03G 9/10 430/110.3

FOREIGN PATENT DOCUMENTS

| | | | |
|---|---|---|---|
| JP | 4-93954 | A | 3/1992 |
| JP | 2004-77568 | A | 3/2004 |
| JP | 2006-337579 | A | 12/2006 |
| JP | 2009-175666 | A | 8/2009 |
| JP | 2012-173315 | A | 9/2012 |

* cited by examiner

*Primary Examiner* — Janis L Dote
(74) *Attorney, Agent, or Firm* — Canon U.S.A. Inc., IP Division

(57) ABSTRACT

A magnetic carrier includes resin-filled magnetic core particles including porous magnetic particles whose pores are filled with a resin, and resin coating layers on the surfaces of the resin-filled magnetic core particles. The porous magnetic particles have specific electrical properties.

8 Claims, 3 Drawing Sheets

MAGNETIC CARRIER, TWO-COMPONENT DEVELOPER, REPLENISHING DEVELOPER, AND IMAGE FORMING METHOD

BACKGROUND OF THE INVENTION

Field of the Invention

The present invention relates to a magnetic carrier, a two-component developer and a replenishing developer used in an image forming method for visualizing electrostatic images by an electrophotographic method, and an image forming method using the same.

Description of the Related Art

In known electrophotographic image forming methods, in general, an electrostatic latent image is formed on an electrostatic latent image bearing member by various techniques, and the electrostatic latent image is developed by applying a toner to the electrostatic latent image. For such development, two-component development is widely adopted, in which the toner is triboelectrically charged to an appropriate positive or negative charge level with carrier particles called magnetic carrier mixed with the toner. The charge applied to the toner acts as driving force of the development.

In two-component development, the magnetic carrier functions to stir, carry, and charge the developer, and thus, the functions of the carrier are clearly divided from those of the toner. Accordingly, the properties of the developer can be easily controlled.

With recent technological evolution in the field of electrophotography, difficult demands to image forming apparatuses are increased for high speed, long life, high definition, and high image quality. To respond to these demands, it is desired to enhance the performance of the magnetic carrier.

For example, Japanese Patent Laid-Open No. 4-93954 discloses an approach to reducing variation in density, or variation in color tinge for full color images, even in long-time use. The carrier used in this discloser features the core material thereof whose particles have asperities exposed at the surfaces even though the particles are coated with a resin. This approach helps to improve the performance of the magnetic carrier to some extent. Under the recent environment requiring high-speed copying, however, much load is placed on the toner due to the high specific gravity of the magnetic carrier particles, and thus, the life of the developer is shortened. Further improvement is therefore required in image quality and adaptability to environmental changes.

Accordingly, Japanese Patent Laid-Open Nos. 2006-337579, 2009-175666, and 2004-77568 disclose approaches, each using porous magnetic cores having pores therein to reduce the specific gravity. The use of these porous magnetic cores for magnetic carriers increases the lifetime of the developer, but creates new issues, such as leakage, blank dots, and graininess. It is imperative to develop a magnetic carrier and a two-component developer that can solve the new issues, and an image forming method using the carrier and developer.

SUMMARY OF THE INVENTION

The present invention provides a magnetic carrier that can solve the above issues and steadily form high-definition images. More specifically, the invention provides a magnetic carrier that can prevent leakage and reduce both blank dots and graininess in images, and that does not adversely affect developability.

The present inventors have found that the following magnetic carrier can prevent leakage and reduce both blank dots and graininess in images, and that does not adversely affect developability.

The present inventor have further found that the resistance of this magnetic carrier does not vary much even though the magnetic carrier is subjected to repeated electric field history in an image forming apparatus.

According to an aspect of the invention, a magnetic carrier is provided which includes resin-filled magnetic core particles containing porous magnetic particles having pores therein and a resin present in the pores, and resin coating layers on the surfaces of the resin-filled magnetic core particles. The resin coating layer includes a coating resin. The porous magnetic particles satisfy: (i) being made of Mn—Mg—Sr ferrite; (ii) having a specific resistance in the range of $1.0\times10^7$ Ω·cm to $1.0\times10^8$ Ω·cm at an electric field intensity of 300 V/cm; and (iii) having an electrical breakdown at electric field intensity in the range of 1,000 V/cm to 10,000 V/cm. The magnetic carrier satisfies: (iv) having a specific resistance in the range of $1.0\times10^7$ Ω·cm to $1.0\times10^9$ Ω·cm at an electric field intensity of 2000 V/cm; (v) having a specific resistance in the range of $2.0\times10^7$ Ω·cm to $2.0\times10^9$ Ω·cm at an electric field intensity of 1000 V/cm; (vi) having an electrical breakdown at electric field intensity in the range of 1,000 V/cm to 15,000 V/cm; and (vii) exhibiting a current in the range of 8.0 μA to 50.0 μA when a voltage of 500 V is applied thereto.

According to another aspect of the invention, a two-component developer is provided which includes a toner containing a binder resin, a coloring agent and a release agent, and the above-described magnetic carrier.

The present invention is also directed to a replenishing developer used in a process of two-component development including the step of charging an electrostatic latent image bearing member, the step of forming an electrostatic latent image on the surface of the electrostatic latent image bearing member, the step of developing the electrostatic latent image into a toner image with a two-component developer in a developing unit, the step of transferring the toner image to a transfer medium using or not using an intermediate transfer medium; and the step of fixing the transferred toner image to the transfer medium. The replenishing developer contains a replenishing magnetic carrier that is the above-described magnetic carrier, and a toner containing a binder resin, a coloring agent, and a release agent. The mass ratio of the toner to the replenishing magnetic carrier is in the range of 2 to 50. In the process of two-component development, the replenishing developer is supplied to the developing unit according to decrease in the toner concentration in the two-component developer in the developing unit, and an excess magnetic carrier is discharged from the developing unit as required.

The present invention is also directed to an image forming method including the step of charging an electrostatic latent image bearing member, the step of forming an electrostatic latent image on the surface of the electrostatic latent image bearing member, the step of developing the electrostatic latent image into a toner image with the above-described two-component developer in a developing unit, the step of transferring the toner image to a transfer medium using or not using an intermediate transfer medium, and the step of fixing the transferred toner image to the transfer medium.

Furthermore, the present invention is directed to an image forming method including the step of charging an electrostatic latent image bearing member, the step of forming an electrostatic latent image on the surface of the electrostatic latent image bearing member, the step of developing the electrostatic latent image into a toner image with a two-component developer in a developing unit, the step of transferring the toner image to a transfer medium using or not using an intermediate transfer medium, and the step of fixing the transferred toner image to the transfer medium. In this method, a replenishing developer is supplied to the developing unit according to the toner concentration in the two-component developer in the developing unit, and an excess magnetic carrier is discharged from the developing unit. The replenishing developer contains a replenishing magnetic carrier that is the above-described magnetic carrier, and a toner containing a binder resin, a coloring agent, and a release agent. The mass ratio of the toner to the replenishing magnetic carrier is in the range of 2 to 50.

Further features of the present invention will become apparent from the following description of exemplary embodiments with reference to the attached drawings.

DESCRIPTION OF THE EMBODIMENTS

Figure 1:
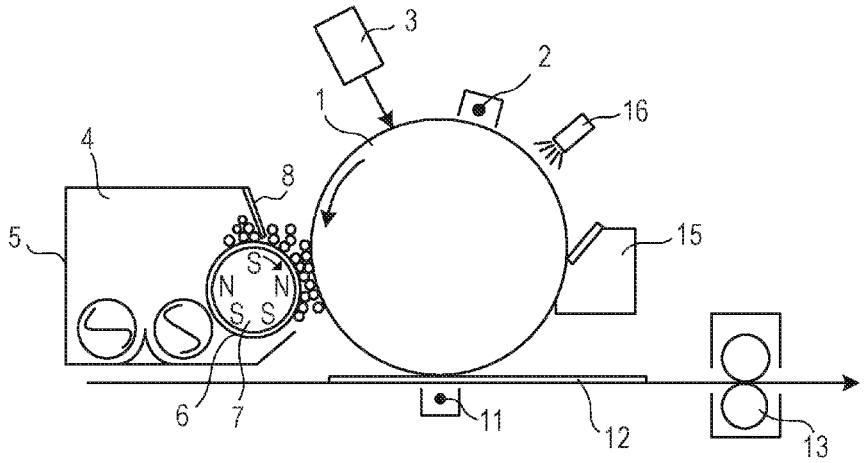
FIG. 1 is a schematic view of an image forming apparatus according to an embodiment of the invention.

A magnetic carrier used in an embodiment of the invention includes resin-filled porous magnetic core particles containing porous magnetic particles having pores therein and a resin present in the pores of the porous magnetic particles, and a resin coating layers on the surfaces of the resin-filled magnetic core particles, the resin coating layer including a coating resin. The porous magnetic particles satisfy: (i) being made of Mn—Mg—Sr ferrite; (ii) having a specific resistance in the range of $1.0\times10^7$ Ω·cm to $1.0\times10^8$ Ω·cm at an electric field intensity of 300 V/cm; and (iii) having an electrical breakdown at electric field intensity in the range of 1,000 V/cm to 10,000 V/cm. The magnetic carrier satisfies: (iv) having a specific resistance in the range of $1.0\times10^7$ Ω·cm to $1.0\times10^9$ Ω·cm at an electric field intensity of 2,000 V/cm; (v) having a specific resistance in the range of $2.0\times10^7$ Ω·cm to $2.0\times10^9$ Ω·cm at an electric field intensity of 1,000 V/cm; (vi) having an electrical breakdown at electric field intensity in the range of 1,000 V/cm to 15,000 V/cm; and (vii) exhibiting a current in the range of 8.0 μA to 50.0 μA when a voltage of 500 V is applied thereto.

If the porous magnetic particles or the magnetic carrier has an electrical breakdown at an electric field intensity lower than the lower limit of the corresponding range of electric field intensity at which the electrical breakdown occurs, the porous magnetic particles have a low resistance. This reduces the ability to reduce graininess and increases the risk of adverse effects resulting from leakage. Also, the resistance of the magnetic carrier tends to decrease when the magnetic carrier has been subjected to repeated electric field history. If the electrical breakdown occurs at an electric field intensity higher than the upper limit for the porous magnetic particles or the magnetic carrier, the porous magnetic particles or magnetic carrier have high resistance, and accordingly cause blank dots. There is a correlation between the range of the electrical breakdown electric field intensity and the resistance of the magnetic carrier.

When the porous magnetic particles have a specific resistance in the range of $1.0\times10^7$ Ω·cm to $1.0\times10^8$ ∩·cm at an electric field intensity of 300 V/cm, the particles leads provides good developability.

When the magnetic carrier has a specific resistance in the range of $1.0\times10^7$ Ω·cm to $1.0\times10^9$ Ω·cm at an electric field intensity of 2,000 V/cm, and has a specific resistance in the range of $2.0\times10^7$ Ω·cm to $2.0\times10^9$ Ω·cm at an electric field intensity of 1,000 V/cm, the carrier provides good developability.

When a voltage of 500 V is applied to the magnetic carrier, the magnetic carrier exhibits a current in the range of 8.0 μA to 50.0 μA. If the current is less than 8.0 μA, marked blank dots occur in the resulting image. If the current exceeds 50.0 μA, graininess becomes noticeable. There are correlations between the current and the total amount of resins used in the carrier, and between the current and the resistance of the carrier.

The magnetic carrier of the present embodiment includes resin-filled magnetic core particles including porous magnetic particles having pores therein and a filling resin present in the pores, and resin coating layers on the surfaces of the resin-filled magnetic core particles. The ability of such a magnetic carrier to release charge can be controlled. Accordingly, the lifetime of the developer can be increased, and, in addition, the density and color of the resulting image can be stabilized.

The porous magnetic particles used in the present embodiment have a pore volume preferably in the range of 20 $mm^3/g$ to 100 $mm^3/g$ in a pore size distribution in the range of 0.1 μm to 3.0 μm. The term pore volume refers to an integrated value of differential pore volume. Porous magnetic particles having a pore volume in this range have adequate strength, accordingly reducing defects in images after durability test. Also, the carrier is prevented from adhering to the electrostatic latent image bearing member.

The porous magnetic particles used in the present embodiment have a peak pore size preferably in the range of 0.15 μm to 1.00 μm in a pore size distribution in the range of 0.1 μm to 3.0 μm. The term peak pore size refers a pore size at which the differential pore volume is largest. Porous magnetic particles having a peak pore size in this range can prevent damage and contamination to the components or members of the electrophotographic apparatus.

The resin content in the resin-filled core magnetic particles is preferably in the range of 1.0 to 5.5 parts by mass relative to 100 parts by mass of the porous magnetic particles. In this range, an appropriate level of current is exhibited. Thus, graininess is reduced, and image density is stabilized. In addition, blank dots and degradation in developability after durability test can be prevented.

In the magnetic carrier, the amount of the coating resin of the resin coating layer is preferably in the range of 1.0 to 3.0 parts by mass relative to 100 parts by mass of the porous magnetic particles. In this range, the magnetic carrier exhibits satisfactory charging ability. Accordingly, graininess is reduced, and image density is stabilized. In addition, blank dots and degradation in developability after durability test can be prevented.

The total amount of the resins used in the magnetic carrier is preferably in the range of 2.0 to 8.5 parts by mass relative to 100 parts by mass of the porous magnetic particles. In this range, graininess is reduced, and image density is stabilized. In addition, blank dots and degradation in developability after durability test can be prevented.

By controlling the resin content of the resin-filled magnetic core particles in the range mentioned a few paragraphs ago, the resin can be present in the pores in such a manner as to maintain properly the asperities of the resin-filled magnetic core particles with the edges of the recesses exposed at the surfaces of the porous magnetic particles. The exposed edges help surface tension act on the coating resin increase the coatability of the coating resin.

The resistance of the magnetic carrier does not decrease much even though the carrier is subjected to repeated electric field history in an image forming apparatus. Thus, the magnetic carrier of the present embodiment is advantageous from the viewpoint of maintaining the resistance.

The present inventors have found, through their studies, it is desirable from the viewpoint of forming stable images that the resistance retention rate of the magnetic carrier using porous magnetic particles be at least 70% when the magnetic carrier is subjected to repeated electric field history. The inventors have also found that when the specific resistance of the porous magnetic particles is more than or equal to the lower limit of the above-mentioned range, a satisfactory resistance retention rate is obtained. The magnetic carrier of the present embodiment is advantageous in this point.

If the specific resistance of the porous magnetic particles is less than the above-mentioned range, the electrical breakdown is liable to occur, and the resistance is likely to be reduced by electrical breakdown inside the particles, accordingly. In contrast, if the specific resistance of the porous magnetic particles exceeds the above range, the resistance of the magnetic carrier is easy to maintain, but blank dots or the like are liable to occur disadvantageously. In addition, if the specific resistance of the magnetic carrier is less than the above-mentioned range, the resistance tends to decrease due to the low specific resistance of the porous magnetic particles. When the porous magnetic particles have a lower specific resistance than the above range, the resistance of the magnetic carrier tends to decrease due to the low specific resistance of the porous magnetic particles even if the specific resistance of the magnetic carrier is increased by increasing the amount of the filling resin or the coating resin.

A process for producing the magnetic carrier of the present embodiment will now be described.

Preparation of Porous Magnetic Particles

The magnetic carrier of the present embodiment includes Mn—Mg—Sr ferrite particles expressed by the following formula: $(MnO)_a(MgO)_b(SrO)_c(M1_2O)_d(M2O)_e(Fe_2O_3)_f$ In the formula, M1 represents a monovalent metal, and M2 represents a divalent metal. The molar fractions a to f satisfy the relationships: $0<a\leq0.5$, $0<b\leq0.1$, $0<c\leq0.05$, $0.2\leq a+b+c\leq0.8$, $0\leq d\leq0.1$, $0\leq e\leq0.1$, and $0.5\leq f\leq0.8$. For example, the monovalent metal may be Li, and the divalent metal may be Cu, Zn or Ca.

From the viewpoint of properly maintaining the magnitude of magnetization and controlling the pore size in a desired range, the asperities at the surfaces of the porous magnetic particles of the magnetic carrier are brought in an appropriate state. It is also desired that the control of the reaction speed of ferritization be easy, and that the specific resistance and magnetic force of the porous magnetic particles be appropriately controlled. Accordingly, Mn—Mg—Sr ferrite is most suitable in view of specific resistance and magnetic force.

In the following description, a process for preparing ferrite porous magnetic particles will be described.

Step 1 (Weighing and Mixing)

Raw materials of ferrite are weighed out and mixed. The raw materials of ferrite include: metal particles, oxides, hydroxides, carbonates, and oxalic acids of Li, Fe, Mn, Mg, Sr, Cu, Zn, or Ca. The raw materials may be mixed in, for example, a ball mill, a planetary mill, a jet mill or a vibrating mill. When hydroxides or carbonates are used as raw materials, the pore volume of the ferrite particles tends to increase more than in the case of using oxides. A ball mill is particularly suitable from the viewpoint of sufficiently mixing the materials. More specifically, weighed ferrite raw materials are placed in a ball mill with balls and pulverized and mixed for 0.1 to 20.0 hours.

Step 2 (Calcination)

The mixture of the pulverized ferrite raw materials is formed into pellets using a pressure forming apparatus, followed by calcination. Calcination is one of the important steps in the process for producing the magnetic carrier of the present embodiment. For example, the mixture of the raw materials is calcined into ferrite at a temperature in the range of 1,000° C. to 1,100° C. for 3 to 5.0 hours. For this operation, the amounts of materials are appropriately adjusted so that the ferritization reaction can proceed satisfactorily. It is also advantageous to establish a reaction atmosphere suitable for the ferritization reaction, such as a nitrogen atmosphere, by, for example, reducing oxygen concentration. The calcination is performed in a furnace, such as a burner furnace, a rotary furnace or an electric furnace.

Step 3 (Pulverization)

The calcined ferrite prepared in Step 2 is pulverized by a pulverizer. Any pulverizer may be used without particular limitation, as long as the material can be pulverized into a desired particle size.

Controlling the particle size of the pulverized material and the distribution thereof is involved with the pore size of the porous magnetic particles and the roughness of the asperities of the magnetic carrier.

In order to control the particle size distribution of the pulverized calcined ferrite, the material of the ball or beads used in, for example, a ball mill or bead mill, and the operation time are controlled. For example, to reduce the particle size of the calcined ferrite, balls having a high specific gravity may be used, or the pulverization time may be lengthened. The material of the balls or beads is not particularly limited as long as a desired particle size and distribution can be obtained. Examples of the ball or bead material include glasses, such as soda glass (specific gravity: 2.5 g/cm$^3$), sodium-free glass (specific gravity: 2.6 g/cm$^3$), and high density glass (specific gravity: 2.7 g/cm$^3$), quartz (specific gravity: 2.2 g/cm$^3$), titania (specific gravity: 3.9 g/cm$^3$), silicon nitride (specific gravity: 3.2 g/cm$^3$), alumina (specific gravity: 3.6 g/cm$^3$), zirconia (specific gravity: 6.0 g/cm$^3$), steel (specific gravity: 7.9 g/cm$^3$), and stainless steel (specific gravity: 8.0 g/cm$^3$). Among those, alumina, zirconia and stainless steel are suitable. These materials are superior in wear resistance. The size of the balls or beads is not particularly limited as long as a desired particle size and distribution can be obtained. If a ball mill is used, for example, the balls may have a diameter in the range of 4 mm to 60 mm. If a bead mill is used, the beads may have a diameter in the range of 0.03 mm to 5 mm. A wet type ball mill or bead mill prevents the pulverized material from being blown up, and accordingly can more efficiently pulverize the material than a dry type. Thus, a wet type pulverizer is more suitable than a dry type.

Step 4 (Granulation)

To the pulverized calcined ferrite, a dispersant, water and a binder, and optionally a pore size adjuster, are added to prepare a slurry. A foaming agent or resin particles may be used as the pore size adjuster. The binder may be, for example, polyvinyl alcohol. If the pulverization in Step 3 is performed by a wet process, it is desirable that a binder, and optionally a pore size adjuster, be added in view of the water contained in the slurry.

The resulting ferrite slurry is dried and granulated using a spray dryer in an atmosphere heated to a temperature of 100° C. to 200° C. Any spray dryer may be used without particular limitation, as long as particles having a desired particle sized can be produced.

The granulated material is burned at a temperature in the range of 600° C. to 800° C. to remove the dispersant and the binder.

Step 5 (Firing)

Then, the resulting material is fired at a temperature in the range of 1,000° C. to 1,300° C. for 1 to 24 hours in an atmosphere with a controlled oxygen concentration in an electric furnace that can control oxygen concentration. The pore volume can be controlled by controlling temperature. For example, the pore volume can be reduced at an increased temperature. Desirably, the pore volume of the porous magnetic particles is in the range of 20.0 $mm^3/g$ to 100.0 $mm^3/g$.

Although it is believed that the ferritization reaction has been almost completed by the calcination, the ferritization reaction with temperature changes is suppressed, just to be on the safe side, by increasing the heating or cooling rate in a temperature range of 700° C. to 1,100° C., in which ferritization reaction proceeds. The highest temperature in the furnace may be held for 3 to 5 hours. In this instance, a rotary electric furnace, or a batch-type or continuous electric furnace may be used so that the atmosphere for the firing can be controlled to reduce the oxygen concentration by introducing thereto an inert gas such as nitrogen or a reducing gas such as hydrogen or carbon monoxide. If a rotary electric furnace is used, a plurality of firing operations may be performed under different conditions in atmosphere or firing temperature.

Step 6 (Screening)

After being crushed, the fired particles are screened for low-magnetic-force particles by magnetic separation, if necessary. Excessively large or small particles may be removed with an air classifier or a sieve.

Step 7 (Surface Treatment)

The resistance of the resulting particles can be controlled, if necessary, by coating the surfaces of the particles with an oxide coating films by low-temperature heating. The oxide coating films can be formed by heat-treating the surfaces of the particles at a temperature in the range of, for example, 300° C. to 700° C. in an ordinary rotary electric furnace, or a batch-type electric furnace.

The porous magnetic particles thus prepared preferably have a volume-based median particle size (D50) in the range of 28.0 μm to 78.0 μm, from the viewpoint of controlling the final particle size of the magnetic carrier in the range of 30.0 μm to 80.0 μm. Such a magnetic carrier enables the toner to be triboelectrically charged, thus helping the increase in the image quality of half-tone images, preventing fog and adhesion of the carrier.

Preparation of Resin-filled Magnetic Core Particles

For filling the pores of the porous magnetic particles with a filling resin composition, a dilution of a filling resin with a solvent may be poured into the pores, followed by removing the solvent. Any solvent may be used as long as it can dissolve the filling resin. The solvent may be an organic solvent such as toluene, xylene, Cellosolve butyl acetate, methyl ethyl ketone, methyl isobutyl ketone, or methanol. For filling the pores of the porous magnetic particles with a resin, alternatively, the porous magnetic particles may be impregnated with a resin solution by immersion, spraying, brush coating, fluidized bed coating, or the like, followed by evaporating the solvent.

For immersion, a solution of a filling resin composition prepared by mixing the filling resin with a solvent at a reduced pressure may be introduced into the pores of the porous magnetic particles, and then the solvent is removed by deaeration or heating.

In the present embodiment, also, how much the filling resin fills the pores of the porous magnetic particles can be controlled by controlling deaeration time. Since the filling resin solution is introduced into the pores by capillarity, a larger amount of filling resin fills the pores of the porous magnetic particles, as the deaeration time increases.

After the filling resin composition has filled the pores, the porous magnetic particles are heated by a known technique to fix the filling resin composition to the porous magnetic particles. The magnetic particles may be externally or internally heated by, for example, using a stationary electric furnace, a fluid electric furnace, a rotary electric furnace, or a burner furnace, or by burning with microwaves.

The solid content in the filling resin composition is preferably in the range of 6% to 50% by mass. When the solid content is in such a range, the solution of the filling resin composition has a viscosity suitable for handling, and is accordingly advantageous in filling the pores and removing the solvent.

Although the filling resin of the filling resin composition is not particularly limited, easily penetrating resins are advantageous. If an easily penetrating resin is used as the filling resin, the pores remain at the surfaces of the resin-filled core particles because the resin can permeate the porous magnetic particles through the pores. Thus, the resin-filled magnetic core particles have asperities formed from the pores at the surfaces thereof. This increases the strength of the coating resin.

The filling resin may be a thermoplastic resin or a thermosetting resin. Thermosetting resins are however suitable because they do not dissolve in the solvent used for coating the magnetic carrier. In addition, silicone resin is more suitable because of easy filling. For example, a commercially available straight silicone resin or modified silicone resin may be used. Exemplary straight silicone resins include KR-271, KR-251, and KR-255 (each produced by Shin-Etsu Chemical); and SR2400, SR2405, SR2410, and SR2411 (each produced by Dow Corning Toray). Exemplary modified silicone resins include KR-206 (alkyd-modified), KR-5208 (acrylic-modified), ES-1001N (epoxy-modified), and SR-2110 (alkyd-modified), each produced by Shin-Etsu Chemical.

The filling resin composition may contain a silane coupling agent. Silane coupling agents are compatible with the filling resin and, accordingly, enhance the wettability and adhesion between the porous magnetic particles and the filling resin. Such a filling resin can easily permeate the porous magnetic particles through the pores. Consequently, the resin-filled magnetic core particles have asperities formed from the pores at the surfaces thereof. This is advantageous in view of surface tension acting on the coating resin composition.

Although the silane coupling agent is not particularly limited, aminosilane coupling agents are advantageous, which have functional groups and accordingly have affinity with the coating resin composition.

The reason why the silane coupling agents, particularly aminosilane coupling agents, can enhance the wettability and adhesion between the porous magnetic particles and the filling resin and increase the affinity with the coating resin composition is probably as below. An aminosilane coupling agent has a site that can react with inorganic compounds, and a site that can react with organic compounds. More specifically, it is believed that the alkoxy group reacts with inorganic compounds and that a functional group having an amino group reacts with organic compounds. Thus, the alkoxy group of the aminosilane coupling agent reacts with the material of the porous magnetic particles, thereby enhancing wettability and adhesion, and the functional groups having an amino group are oriented toward the filling resin molecules. Consequently, the resin-filled magnetic core particles have high affinity with the coating resin composition.

The silane coupling agent content in the filling resin composition is preferably in the range of 1.0 to 20.0 parts by mass relative to 100 parts by mass of the filling resin. More preferably, it is in the range of 5.0 to 10.0 parts by mass, from the viewpoint of enhancing the wettability and adhesion between the porous magnetic particles and the filling resin.

Production of Magnetic Carrier

The resin-filled magnetic core particles are coated with a coating resin composition by, for example, immersion, spraying, brush coating, fluidized bed coating, or any other coating technique. The coating technique is not particularly limited. However, from the viewpoint of maintaining the asperities of the resin-filled magnetic core particles, immersion is suitable. Immersion can control the proportion between the thin portions and the thick portions of the coating layer, and is advantageous in enhancing developability. The reason why developability is enhanced is probably as below. The asperities of the resin-filled magnetic core particles allow the layers of the coating resin composition to have thin portions and thick portions, and the thin portions locally present in the coating resin layer function to reduce the charge.

The coating resin composition can be prepared in the same manner as the filling resin composition. To prevent aggregation during the coating operation, the resin content of the coating resin composition or the temperature in the apparatus used for coating may be adjusted. The temperature or the degreed of reducing the pressure may be adjusted for removing the solvent. The number of times of coating operations may be controlled.

The coating resin of the coating resin composition is not particularly limited, and may a vinyl copolymer of a vinyl monomer having a cyclic hydrocarbon group in the molecule and another vinyl monomer. By coating the magnetic particles with such a vinyl copolymer, the decrease in charge under an environment of high temperature and high humidity can be prevented.

The reason of this is probably as below. For coating the resin-filled magnetic core particles with the above-described vinyl resin, a solution of the vinyl resin in an organic solvent and the resin-filled magnetic core particles are mixed, and then the solvent is removed. Through these steps, the solvent is removed while the highly hydrophobic cyclic hydrocarbon groups are being oriented to the surfaces of the coating resin layers, and the coating resin layers are thus formed with the cyclic hydrocarbon groups oriented on the surfaces of the completed magnetic carrier.

Examples of the cyclic hydrocarbon group include cyclic hydrocarbon groups having a carbon number of 3 to 10, such as cyclohexyl, cyclopentyl, adamantyl, cyclopropyl, cyclobutyl, cycloheptyl, cyclooctyl, cyclononyl, cyclodecyl, isobornyl, norbornyl, and boronyl. Among these, the cyclohexyl, cyclopentyl and adamantyl groups are advantageous, and the cyclohexyl group is particularly advantageous because it is stable in structure and accordingly has high adhesion to the resin-filled magnetic core particles. The other monomer of the vinyl copolymer may be added to increase the glass transition temperature (Tg).

Such a monomer can be selected from known monomers, such as styrene, ethylene, propylene, butylene, butadiene, vinyl chloride, vinylidene chloride, vinyl acetate, methyl methacrylate, ethyl methacrylate, propyl methacrylate, methyl vinyl ether, ethyl vinyl ether, and methyl vinyl ketone.

The vinyl resin used for forming the coating layer may be a graft copolymer. Graft copolymers are advantageous from the viewpoint of enhancing the wettability to the resin-filled magnetic core particles to form a uniform coating layer.

For producing a graft copolymer, the main chain of the vinyl resin may be subjected to graft copolymerization, or copolymerization using a macromonomer as a monomer may be performed. Copolymerization using a macromonomer is advantageous because it can make it easy to control the molecular weight of the graft chain.

Although the macromonomer is not particularly limited, methyl methacrylate macromonomer is advantageous from the viewpoint of further enhancing the wettability to the resin-filled magnetic core particles.

The amount of macromonomer used for the polymerization is preferably in the range of 10 to 50 parts by mass, more preferably in the range of 20 to 40 parts by mass, relative to 100 parts by mass of the vinyl copolymer defining the main chain.

The coating resin composition may further contain electroconductive particles or charge-controllable particles or material. Exemplary electroconductive particles include particles of carbon black, magnetite, graphite, zinc oxide, and tin oxide. Among these, carbon black is advantageous. Carbon black, which is added as filler to the coating resin composition, helps surface tension act on the coating resin composition so as to increase the coatability of the coating resin composition.

The reason why carbon black used as filler increases the coatability of the coating resin composition is based on the primary particle size and the aggregating nature of carbon black. Carbon black has a small primary particle size, and accordingly has a large specific surface area. Carbon black is, however, easy to aggregate and is thus likely to exist in the form of aggregate having a large particle size. The small primary particle size and the aggregating nature of carbon black break the relationship between the particle size and the specific surface area of particles. More specifically, carbon black has a particle size that helps a surface tension to act on the coating resin composition, and comes in contact with a surface with a large contact area because of the large specific surface area thereof. Thus a larger surface tension is likely to act on the coating resin composition.

The content of the electroconductive particles is preferably in the range of 0.1 to 10.0 parts by mass relative to 100 parts by mass of the coating resin from the viewpoint of controlling the resistance of the magnetic carrier. Exemplary charge-controllable particles include particles of organic metal complexes, organic metal salts, chelate compounds, monoazo metal complexes, acetyl acetone metal complexes, hydroxycarboxylic acid metal complexes, polycarboxylic acid metal complexes, polyol metal complexes, polymethyl methacrylate resin, polystyrene resin, melamine resin, phenol resin, nylon resin, silica, titanium oxide, and alumina. The content of the charge-controllable particles is preferably in the range of 0.5 to 50.0 parts by mass relative to 100 parts by mass of the coating resin from the viewpoint of controlling the amount of triboelectric charge.

The specific resistance of the magnetic carrier of the present embodiment, measured as described below is, preferably, in the range of $2.0\times10^7$ Ω·cm to $2.0\times10^9$ Ω·cm at an electric field intensity of 1,000 V/cm, and in the range of $1.0\times10^7$ Ω·cm to $1.0\times10^9$ (Ω·cm) at an electric field intensity of 2,000 V/cm, from the viewpoint of reducing blank dots and graininess.

A toner suitably used in an embodiment of the present invention will now be described. The toner contains a binder resin, a coloring agent and a release agent. The binder resin may be a vinyl resin, polyester resin or epoxy resin. Vinyl resin and polyester resin are advantageous in chargeability and fixability. In particular, polyester resin can produce a large effect in the embodiment.

The binder resin may be mixed, if necessary, with another resin, such as a monopolymer or copolymer of vinyl monomer, polyester, polyurethane, epoxy resin, polyvinyl butyral, rosin, modified rosin, terpene resin, phenol resin, aliphatic or alicyclic hydrocarbon resin, or aromatic petroleum resin.

If the binder resin is in the form of mixture of two or more resins, resins having different molecular weights may be mixed with an appropriate proportion.

The binder resin has a glass transition temperature preferably in the range of 45° C. to 80° C., more preferably 55° C. to 70° C. Preferably, the binder resin has a number average molecular weight (Mn) of 2,500 to 50,000 and a weight average molecular weight (Mw) of 10,000 to 1,000,000.

A polyester resin as described below may be used as the binder resin. The polyester resin contains 45% to 55% by mole of an alcohol component and 55% to 45% by mole of an acid component.

The polyester resin preferably has an acid value of 90 mg KOH/g or less, more preferably 50 mg KOH/g or less, and a hydroxyl value of 50 mg KOH/g or less, more preferably 30 mg KOH/g or less. As the molecular chain of the binder resin has a larger number of terminal groups, the chargeability of the toner is more dependent on environment.

The polyester resin has a glass transition temperature preferably in the range of 50° C. to 75° C., more preferably 55° C. to 65° C. The number average molecular weight (Mn) of the polyester resin is preferably 1,500 to 50,000, and more preferably 2,000 to 20,000. The weight average molecular weight (Mw) of the polyester resin is preferably 6,000 to 100,000, and more preferably 10,000 to 90,000.

If the toner is used as a magnetic toner containing a magnetic material, the magnetic material may be an iron oxide such as magnetite, maghemite, ferrite, or an iron complex oxide containing another metal oxide; an elemental metal, such as Fe, Co, or Ni, or an alloy of these elemental metals with Al, Co, Cu, Pb, Mg, Ni, Sn, Zn, Sb, Be, Bi, Cd, Ca, Mn, Se, Ti, W, or V; or a mixture of these elements or compounds.

More specifically, examples of the magnetic material include triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni).

The magnetic material is used with a proportion of 20 to 150 parts by mass, preferably 50 to 130 parts by mass, more preferably 60 to 120 parts by mass, relative to 100 parts by mass of the binder resin. The coloring agent used in the toner, which is nonmagnetic material, may be as described below.

The black coloring agent may be carbon black or a mixture of a yellow coloring agent, a magenta coloring agent and a cyan coloring agent, whose color is adjusted to black.

Pigments that can be used in a magenta toner include condensed azo compounds, diketopyrrolopyrrole compounds, anthraquinone, quinacridone compounds, basic dye lakes, naphthol compounds, benzimidazolone compounds, thioindigo compounds, and perylene compounds. More specifically, examples of the magenta pigment include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269, C.I. Pigment Violet 19, and C.I. Vat Reds 1, 2, 10, 13, 15, 23, 29, and 35.

The magenta pigment may be uses singly as the coloring agent of the magenta toner, or may be used in combination with a dye. The combined use with a dye increases the clearness of the coloring agent and is thus advantageous in view of image quality of the resulting full color images.

Examples of the dye used for a magenta toner include oil-soluble dyes, such as C.I. Solvent Reds 1, 3, 8, 23, 24, 25, 27, 30, 49, 81, 82, 83, 84, 100, 109, and 121, C.I. Disperse Red 9, C.I. Solvent Violets 8, 13, 14, 21, and 27, and C.I. Disperse Violet 1; and basic dyes, such as C.I. Basic Reds 1, 2, 9, 12, 13, 14, 15, 17, 18, 22, 23, 24, 27, 29, 32, 34, 35, 36, 37, 38, 39, and 40, and C.I. Basic Violets 1, 3, 7, 10, 14, 15, 21, 25, 26, 27, and 28.

Pigments that can be used in a cyan toner include C.I. Pigment Blues 1, 2, 3, 7, 15:2, 15:3, 15:4, 16, 17, 60, 62, and 66, C.I. Vat Blue 6, C.I. Acid Blue 45, and a copper phthalocyanine pigment having a phthalocyanine skeleton substituted with one to five methyl phthalimide molecules.

Pigments that can be used in a yellow toner include condensed azo compounds, isoindolinone compounds, anthraquinone compounds, azo metal compounds, methine compounds, and allyl amide compounds. More specifically, examples of the yellow pigment include C.I. Pigment Yellows 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C.I. Vat Yellows 1, 3, and 20. Dyes may also be used such as C.I. Direct Green 6, C.I. Basic Greens 4 and 6, and Solvent Yellow 162.

The coloring agent content in the toner is preferably in the range of 0.1 to 30 parts by mass, more preferably 0.5 to 20 parts by mass, most preferably 3 to 15 parts by mass, relative to 100 parts by mass of the binder resin.

A masterbatch may be prepared by adding a coloring agent to all or a part of the binder resin for preparing the toner. By dissolving and mixing the coloring agent masterbatch with the other constituents (including the rest of the binder resin and the release agent), the coloring agent is satisfactorily dispersed in the toner.

The toner of the present embodiment may further contain a charge control agent so as to exhibit steady chargeability. The amount of the charge control agent used is preferably 0.5 to 10 parts by mass relative to 100 parts by mass of the binder resin. The following charge control agents may be used.

The charge control agent may be a negative charge control agent that controls the toner to a negatively charged state. For example, an organic metal complex or a chelate compound can be effective. Examples of the negative charge control agent include monoazo metal compounds; aromatic hydroxycarboxylic acids, aromatic monocarboxylic acids, aromatic polycarboxylic acids including aromatic dicarboxylic acids, and metal complexes, metal salts, anhydrides and esters of these aromatic carboxylic acids; and phenol derivatives of bisphenol.

Examples of the positive charge control agent, which controls the toner to a positively charged state, include compounds modified with nigrosine or a metal salt of a fatty acid; quaternary ammonium salts such as tributylbenzylammonium-1-hydroxy-4-naphthsulfonates and tetrabutylammonium tetrafluoroborate; onium salts such as phosphonium salts, similar to the foregoing quaternary ammonium salts, chelate compounds of onium salts such as triphenylmethane dye and lake pigments of the onium salts (prepared using a lake-forming agent, such as phosphotungstic acid, phosphomolybdic acid, phosphotungsten molybdic acid, tannic acid, lauric acid, gallic acid, ferricyanic acid, or ferrocyanide); and higher fatty acid salts such as diorgano tin oxides (dibutyl tin oxide, dioctyl tin oxide, dicyclohexyl tin oxide, etc.), and diorgano tin borates (dibutyl tin borate, dioctyl tin borate, dicyclohexyl tin borate, etc.)

In the present embodiment, the toner contains one or more release agents. The following release agent may be used.

Aliphatic hydrocarbon waxes are advantageously used, such as low-molecular-weight polyethylene, low-molecular-weight polypropylene, microcrystalline wax, and paraffin wax. Examples of other release agents include oxides of aliphatic hydrocarbon waxes such as polyethylene oxide waxes, and block copolymers of aliphatic hydrocarbon waxes; waxes mainly containing a fatty acid ester, such as carnauba waxes, Sasol Wax (trade name), and montanic acid ester waxes; and partially or fully deoxidized fatty acid esters, such as deoxidized carnauba waxes.

The release agent content is preferably 0.1 to 20 parts by mass, more preferably 0.5 to 10 parts by mass, relative to 100 parts by mass of the binder resin.

The melting point of the release agent, defined by the highest endothermic peak temperature measured during heating with a differential scanning calorimeter (DSC), is preferably 65° C. to 130° C. More preferably, the melting point is 80° C. to 125° C. A release agent having such a melting point favorably helps prevent the toner from adhering to the electrostatic latent image bearing member while maintaining the low-temperature fixability of the toner.

A fine powder capable of increasing the fluidity of the toner may be added as a fluidity enhancing agent to the toner. For example, such a fluidity enhancing agent may be produced by hydrophobizing a fine powder of fluororesin such as vinylidene fluoride or polytetrafluoroethylene, silica fine powder produced in a wet process or a dry process, titanium oxide fine powder, or alumina fine powder by surface-treatment with a silane coupling agent, a titanium coupling agent, or a silicone oil. The hydrophobicity of the resulting fluidity enhancing agent, measured by methanol titration is preferably in the range of 30 to 80.

The toner may contain inorganic particles with a content of 0.1 to 10 parts by mass, preferably 0.2 to 8 parts by mass, relative to 100 parts by mass of the toner.

The above-described toner can be used in a two-component developer. The two-component developer contains the toner and a magnetic carrier. In this instance, the toner content in the developer is desirably in the range of 2% by mass to 15% by mass, and preferably in the range of 4% by mass to 13% by mass.

The toner may also be used in a replenishment developer that will be used for replenishing a developing unit according to the decrease in the toner concentration of the two-component developer in the developing unit. For such a replenishing developer, the toner content is in the range of 2 to 50 parts by mass relative to 1 part by mass of the replenishing magnetic carrier.

An image forming method of an embodiment, using the magnetic carrier, the two-component developer and the replenishing developer of the above-described embodiment will now be described. The image forming method uses an image forming apparatus including a developing unit using the magnetic carrier, the two-component developer and the replenishing developer. The image forming apparatus is not limited to the structure described below.

Image Forming Method

Figure 2:
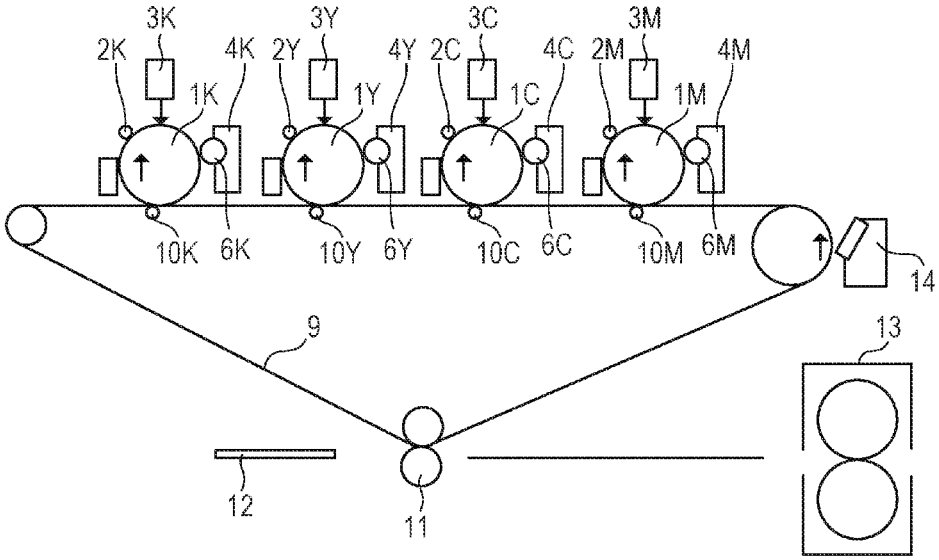
FIG. 2 is a schematic view of an image forming apparatus according to an embodiment of the invention.

FIG. 1 shows an image forming apparatus according to an embodiment of the invention. The image forming apparatus includes an electrostatic latent image bearing member 1 that rotates in the direction indicated by the arrow. The electrostatic latent image bearing member 1 is charged by a charger 2 or a charging device, and an electrostatic latent image is formed on the surface of the charged electrostatic latent image bearing member 1 by exposure from an exposure device 3 that is an electrostatic latent image forming device. The image forming apparatus also includes a developing unit 4 including a developing container 5 containing the two-component developer, and a developer bearing member 6. The developer bearing member 6 is in a rotatable state and includes therein magnets 7 that can generate a magnetic field. At least one of the magnets 7 opposes the electrostatic latent image bearing member 1. The two-component developer is held on the developer bearing member 6 by a magnetic field generated by the magnets 7 and is conveyed in an amount controlled by a regulation member 8 to a developing portion opposing the electrostatic latent image bearing member 1. In the developing portion, the two-component developer is formed into a magnetic brush by the magnetic field generated by the magnets 7. Then, an electrostatic latent image is visualized into a toner image by applying a developing bias, which is produced by superimposing an alternating electric filed on a direct electric field, to the electrostatic latent image. The toner image on the electrostatic latent image bearing member 1 is electrostatically transferred to a recording medium (transfer medium) 12 with a transfer charger 11. In this instance, the toner image may be temporarily transferred to an intermediate transfer medium 9 from the electrostatic latent image bearing member 1, and then electrostatically transferred to the recording medium 12, as shown in FIG. 2. The recording medium 12 is then conveyed to a fuser 13 and heated in the fuser 13 to fix the toner to the recording medium. The recording medium 12 is then ejected as an output image from the apparatus. After the transfer operation, the toner remaining on the electrostatic latent image bearing member 1 is removed by a cleaner 15. The electrostatic latent image bearing member 1 cleaned with the cleaner 15 is electrically initialized by being exposed to light from an exposure device 16, and is thus used repeatedly for forming images.

For developing operation, a two-component development method may be applied, in which a replenishing developer is supplied to the developing unit according to the decrease in toner concentration in the two-component developer in the developing unit, and an excess magnetic carrier is discharged from the developing unit as required.

The replenishing developer may contain a replenishing magnetic carrier, and a toner containing a binder resin, a coloring agent and a release agent. The mass ratio of the toner to the replenishing magnetic carrier may be in the range of 2 to 50. The replenishing magnetic carrier may be the magnetic carrier of the above-described embodiment.

FIG. 2 schematically shows a full color image forming apparatus using the image forming method of an embodiment of the invention. The arrangement of the image forming units K, Y, C and M and the rotation direction of the units are not limited to those shown in FIG. 2. In FIG. 2, K represents black, Y represents yellow, C represents cyan, and M represents magenta. In the full color image forming apparatus shown in FIG. 2, electrostatic latent image bearing members 1K, 1Y, 1C and 1M rotate in the direction indicated by the arrows. The electrostatic latent image bearing members 1K, 1Y, 1C and 1M are charged by the corresponding chargers 2K, 2Y, 2C and 2M or charging devices, respectively, and electrostatic latent images are formed on the surfaces of the charged electrostatic latent image bearing members by exposure from exposure devices 3K, 3Y, 3C, and 3M, respectively, that are electrostatic latent image forming devices. Then, the electrostatic latent images are visualized into toner images with the two-component developer held on the developer bearing members 6K, 6Y, 6C and 6M of developing units 4K, 4Y, 4C and 4M, respectively. The toner images are transferred to an intermediate transfer medium 9 with intermediate transfer chargers 10K, 10Y, 10C and 10M that are transfer devices. The transferred toner images are further transferred to a recording medium 12 with a transfer charger 11 or a transfer device. The recording medium 12 is heated and pressurized to fix the toner in a fuser 13, or fixing device. Thus, the toner images are output as an image. Then, an intermediate transfer cleaner 14, which is a cleaning member for the intermediate transfer medium 9, collects the toner remaining after transfer. More specifically, the developing operation in the present embodiment may be performed in a state where a magnetic brush is in contact with the electrostatic latent image bearing member while an alternating electric field is being generated in a developing region by applying an alternating voltage to the developer bearing member. The distance between the developer bearing member (developing sleeve) 6 and the electrostatic latent image bearing member (S-D distance) is preferably in the range of 100 μm to 1,000 μm from the viewpoint of preventing adhesion of the carrier and enhancing dot reproduction.

The alternating electric field has a peak-to-peak voltage (Vpp) in the range of 300 V to 3,000 V, preferably 500 V to 1,800 V. The frequency, in this instance, is in the range of 500 Hz to 10,000 Hz, preferably 1,000 Hz to 7,000 Hz, and is appropriately set according to the operation. The alternating bias for generating the alternating electric field may be in a triangular or rectangular waveform, or in a waveform formed by varying the duty ratio. In order to respond to changes of the toner image forming speed, it is advantageous to apply an alternating developing bias voltage (intermittent alternating superimposed voltage) having discontinuous bias voltage to the developer bearing member for development.

The use of the two-component developer containing an appropriately charged toner can reduce the voltage (Vback) for eliminating fog, and also reduce the primary charge of the electrostatic latent image bearing member, thus lengthening the lifetime of the electrostatic latent image bearing member. The Vback voltage, which depends on the developing system, may be 200 V or less, and preferably 150 V or less. Contrast potential is preferably in the range of 100 V to 400 V from the viewpoint of yielding a sufficient image density.

Although a frequency lower than 500 Hz may affect the process speed, the structure of the electrostatic latent image bearing member may be the same as that of the photosensitive members of generally used image forming apparatuses. For example, the electrostatic latent image bearing member may include an electroconductive layer, an undercoat layer, a charge generation layer, a charge transport layer, and, optionally, a charge injection layer, in that order, on an electroconductive substrate of aluminum, SUS, or the like.

The electroconductive layer, the undercoat layer, the charge generation layer and the charge transport layer may be the same as those generally used in a photosensitive member. The uppermost layer of the electrostatic latent image bearing member may be a charge injection layer or a protective layer.

Figure 3A:
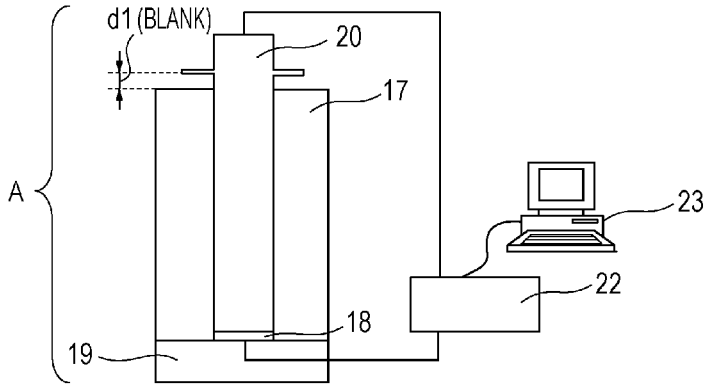
FIGS. 3A and 3B are schematic views of a system for measuring the specific resistances of porous magnetic particles and a magnetic carrier used in an embodiment of the invention.
Figure 3B:
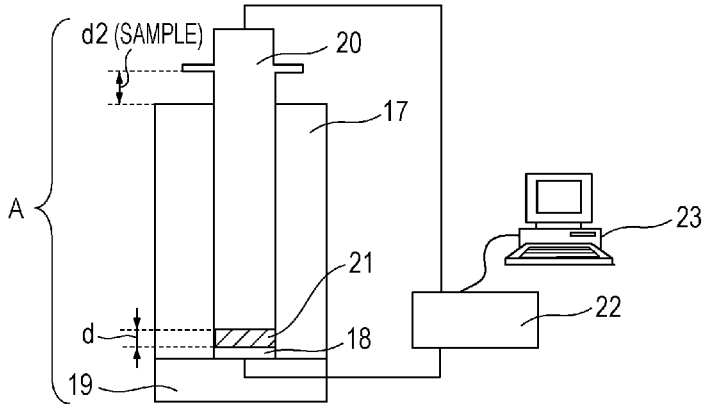

Measurement of Specific Resistances of Magnetic Carrier and Porous Magnetic Particles The specific resistances of the magnetic carrier and the porous magnetic particles are measured with the measuring systems schematically shown in FIGS. 3A and 3B. The specific resistances are measured at electric field intensities of 2,000 V/cm and 1,000 V/cm for the magnetic carrier, and at an electric field intensity of 300 V/cm for the porous magnetic particles.

Resistance measuring cell A includes a cylindrical container (made of PTFE resin) 17 having a hole of 2.4 $cm^2$ in cross section, a lower electrode (made of stainless steel) 18, a supporting base (made of PTFE resin) 19, and an upper electrode (made of stainless steel) 20. The cylindrical container 17 with the lower electrode 18 therein is placed on the supporting base 19 and charged with a sample (magnetic carrier or porous magnetic particles) 21 to a thickness of about 1 mm. Then, the upper electrode 20 is placed on the sample 21 in the container, and the thickness of the sample 21 is measured in this state. Distance d1 shown in FIG. 3A represents a distance when there is no sample, and distance d2 shown in FIG. 3B represents the distance when the container is charged with a sample to a thickness of about 1 mm. In this instance, the thickness d of the sample is calculated using the following equation: $d=d2-d1$ (mm).

For the measurement, the thickness d is adjusted in the range of 0.95 mm to 1.04 mm by varying the mass of the sample.

The specific resistance is obtained by measuring the current when a direct current voltage is applied between the electrodes. For this measurement, an electrometer 22 (Keithley 6517A, manufactured by Keithley) and a processing computer 23 for control are used.

For controlling the measurement in the Examples described below, a control system manufactured by National Instruments and a controlling software program (LabVEIW produced by National Instruments) were used.

Measurement is performed under the condition: contact area of the sample with the electrode $S=2.4$ $cm^2$. The thickness d of the sample, which is adjusted in the range of 0.95 mm to 1.04 mm, is measured, and the actual measurement value d is input. The load of the upper electrode is set to 270 g, and the maximum applied voltage is set to 1000 V.

Specific resistance(Ω·cm)=(applied voltage(V)/measured current(A))×S($cm^2$)/d(cm)

Electric field intensity(V/cm)=applied voltage(V)/d (cm)

The specific resistances of the magnetic carrier and the porous magnetic particles at the above-mentioned electric field intensities are the specific resistances at those electric field intensities on a graph. The breakdown point at which electrical breakdown occurs is the measured value on a graph, immediately before electrical breakdown.

Measurement of Resistance Retention Rate of Magnetic Carrier

The resistance retention rate is also measured with the measuring system shown in FIGS. 3A and 3B. The container is charged with a sample to a thickness of 0.5 mm. For the measurement, the thickness of the sample is adjusted in the range of 0.45 mm to 0.55 mm by varying the mass of the sample. Voltages of 5, 10, 20, 30, 40, 50, 75 and 100 V are manually applied in that order to the sample. Then, the applied voltage is reduced to 100, 75, 50, 40, 30, 20, 10 and 5 V in that order. Resistances at each applied voltage are recorded. This operation is repeated 10 times. The resistance retention rate is calculated from the resistance (Ω1) at the time of the first voltage application, and the voltage (Ω2) at the time of the final voltage application.

Resistance retention rate(%)=(Ω2/Ω1)×100

The resistance retention rate of the magnetic carrier has a correlation with a resistance retention rate of the magnetic carrier on a long time use.

Measurement of Volume-based Median Particle Size (D50)

Particle size distribution measurement is performed with a laser diffraction/scattering particle size distribution analyzer Microtrac MT3300EX (manufactured by Nikkiso).

For the measurement of volume-based median particle sizes (D50) of the magnetic carrier and the porous magnetic particles, a dry-type sample feeder "One-shot dry Sample Conditioner Turbotrac" (manufacture by Nikkiso) was installed. Turbotrac was used for sample supply with a dust collector as a vacuum source under the conditions: air flow rate of about 33 L/s; pressure of about 17 kPa. The measurement is automatically controlled by a software program. The median particle size D50 is obtained from a volume-based particle size distribution. For control and analysis, a software program (Version 10.3.3-202D) supplied with the measuring system is used. The measurement is performed under the following conditions:

Set Zero Time: 10 s
Measuring time: 10 s
Number of times of measurement: once
Refractive index of particles: 1.81%
Shape of particles: Not spherical
Upper limit of measurement: 1408 μm
Lower limit of measurement: 0.243 μm
Measurement environment: 23° C., 50% RH Measurement of Pore Size and Pore Volume of Porous Magnetic Particles The pore size distribution can be measured by a mercury intrusion method. The measurement principal will be described below.

In this measurement, the pressure applied to mercury is varied, and the amount of mercury penetrating the pores at this time is measured. Mercury can penetrate the pores under the condition of $PD=-4\sigma(\cos\theta)$, wherein P represents pressure, D represents the pore diameter, θ represents the contact angle of mercury, and σ represents the surface tension acting on the mercury. When the contact angle and the surface tension are constant, the pressure P is in inverse proportion to the diameter D of the pore that mercury penetrates. A P-V curve is prepared by measuring the amount V of penetrated mercury with varying pressure P. For pore size distribution, the pressure P, represented by the horizontal axis, in the P-V curve is replaced with the diameter of pores.

For this measurement, a fully automatic multifunctional mercury porosimeter PoreMaster series or PoreMaster-GT series manufactured by Yuasa Ionics or an automatic porosimeter AutoPore IV 9500 series manufactured by Shimadzu may be used.

More specifically, measurement was performed using Shimazu AutoPore IV 9520 under the following conditions according to the following procedure.

Measuring Conditions

Measurement environment: 20° C.
Measuring cell: sample volume of 5 $cm^3$, intrusion volume of 1.1 $cm^3$, for measuring powder
Measuring range: 2.0 psia (13.8 kPa) or more and 59989.6 psia (413.7 kPa) or less
Number of Regular steps: 80 steps (at regular intervals in a logarithmic plot of pore size)
Intrusion Parameters: Exhaust pressure 50 μmHg
Exhaust time 5.0 minutes
Mercury intrusion pressure 2.0 psia (13.8 kPa)
Equilibrium time: 5 s
High pressure parameters Equilibrium time: 5 s
Mercury parameter advancing contact angle: 130.0°
Receding contact angle: 130.0°
Surface tension 485.0 mN/m (485.0 dynes/cm)
Mercury density: 13.5335 g/mL Procedure (1) About 1.0 g of porous magnetic particles are weighed out and placed in a sample cell.

The weight of the particles is input.

(2) Measurement is performed at low pressures in the range of 2.0 psia (13.8 kPa) to 45.8 psia (315.6 k Pa).
(3) Measurement is performed at high pressures in the range of 45.9 psia (316.3 kPa) to 59989.6 psia (413.6 kPa).
(4) The pore size distribution is calculated from the mercury intrusion pressure and the amount of intruded mercury.

Steps (2), (3) and (4) were automatically performed with the software program supplied with the apparatus.

From the measured pore size distribution, the pore size in the range of 0.1 μm to 3.0 μm with which the differential pore volume becomes largest is read. This pore size is defined as the peak pore size in embodiments of the invention.

Also, the pore volume, which is an integrated value of the differential pore size in the range of 0.1 μm to 3.0 μm, was calculated using the software program supplied with the apparatus.

Measurement of Current

Figure 4:
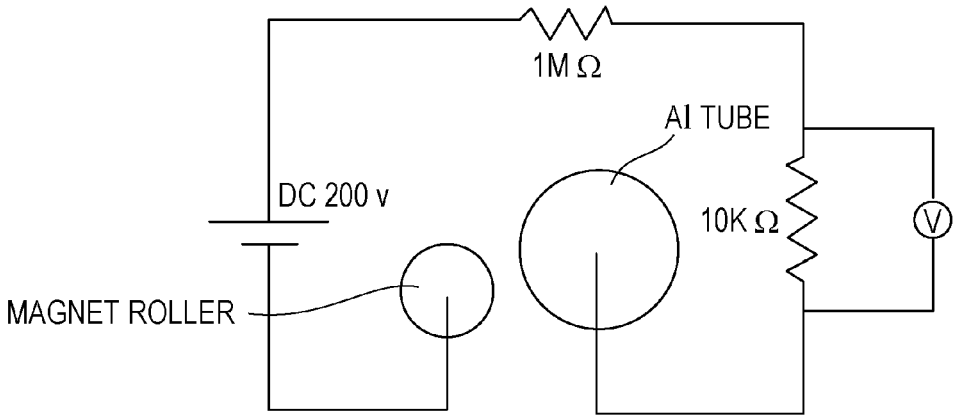
FIG. 4 is a schematic view of a current measuring instrument for a magnetic carrier used in an embodiment of the invention.

The magnetic carrier was weighed to 800 g, and exposed to an environment at a temperature of 20° C. to 26° C. and a humidity of 50% to 60% RH for 15 minutes or more. Then, current was measured at an applied voltage of 500 V with a current measuring unit using a magnetic roller and an Al tube as electrodes, disposed at an interval of 4.5 mm, as shown in FIG. 4.

Measurement of Weight Average Particle size (D4) and Number Average Particle Size (D1)

The weight average particle size (D4) and the number average particle size (D1) of the toner were measured by a pore electric resistance method with a 100 μm-aperture tube, using a precise particle size distribution analyzer "Coulter Counter Multisizer 3" (registered trademark) manufactured by Beckman Coulter and a software program Coulter Counter Multisizer 3 Version 3. 51 supplied from Beckman Coulter with the analyzer. The effective number of measurement channels was 25,000.

The electrolyte solution used for the measurement may be prepared by dissolving highest-quality sodium chloride in ion exchanged water to about 1% by mass, and, for example, ISOTON II (produced by Beckman Coulter) may be used.

Before measurement and analysis, the software program was set up as below. The total count in the control mode is set to 50,000 particles on the "standard measurement (SOM) change screen (in Japanese)" of the software. Also, the number of measurements is set to 1, and Kd is set to a value obtained by use of "10.0 μm standard particles" (produced by Beckman Coulter). On pressing the threshold/noise level measurement button, the threshold and noise level are automatically set. The Current is set to 1,600 μA; the Gain, to 2; and the electrolyte solution, to ISOTON II. A check mark is placed at the statement of "flush of aperture tube after measurement (in Japanese)".

On the "Pulse-to-Particle Size Conversion Setting Screen (in Japanese)" of the software, the bin distance is set to logarithmic particle size, the particle size bin to 256 particle size bins, and the particle size range to 2 μm to 60 μm.

Specifically, the measurement is performed according to the following procedure:

(1) About 200 mL of the electrolyte solution is placed in a Multisizer-3-specific 250 mL glass round bottom beaker, and stirred with a stirrer rod counterclockwise at 24 revolutions per second with the beaker set on a sample stand. The dirt and air bubbles in the aperture tube are removed by the "Aperture Flush" function of the software.

(2) About 30 mL of the electrolyte solution is placed in a 100 mL glass flat bottom beaker. About 0.3 mL of dispersant "CONTAMINON N" dilute solution is added to the electrolyte. CONTAMINON N is a 10% by mass aqueous solution of a pH 7 neutral detergent for precision measurement instruments containing a nonionic surfactant, an anionic surfactant, and an organic builder, produced by Wako Pure Chemical Industries, and the dilute solution of CONTAMINON N is prepared by diluting CONTAMINON N to three times its mass with ion exchanged water.

(3) A predetermine amount of ion exchanged water is placed in a water tank of an ultrasonic dispersion system Tetora 150 (manufactured by Nikkaki Bios) having an electric power of 120 W, containing two oscillators of 50 kHz in oscillation frequency in a state where their phases are shifted by 180°. About 2 mL of CONTAMINON N is added to this water tank.

(4) The beaker of the above (2) is set to a beaker securing hole of the ultrasonic dispersion system, and the ultrasonic dispersion system is started. Then, the level of the beaker is adjusted so that the resonance of the surface of the electrolyte solution in the beaker can be largest.

(5) In a state where ultrasonic waves are applied to the electrolyte solution in the beaker of (4), about 10 mg of toner is added little by little to the electrolyte and dispersed. Such ultrasonic dispersion is further continued for 60 seconds. For the ultrasonic dispersion, the water temperature in the water tank is appropriately controlled in the range of 10° C. to 40° C.

(6) The electrolyte solution of (5), in which the toner is dispersed, is dropped using a pipette into the round bottom beaker of the above (1) set on the sample stand to adjust the measurement concentration to about 5%. Then, the measurement is performed until the number of measured particles comes to 50,000.

(7) The measurement data is subjected to analysis of the software to calculate the weight average particle size (D4) and the number average particle size (D1). "Average size" on the "Analysis/Volume Statistic Value (Arithmetic Mean) screen (in Japanese)" in a state where graph/% by volume is set on the software refers to the weight average particle size (D4), and "Average size" on the "Analysis/Number Statistic Value (Arithmetic Mean) screen (in Japanese)" in a state where graph/% by number is set on the software refers to the number average particle size (D1).

Calculation of Amount of Fine Powder

The amount of the fine powder in the toner on a number basis (percent by number) is calculated as below. For example, for obtaining the amount on a number basis (percent by number) of particles of 4.0 μm or less in the toner, the following procedure is performed after the above-described measurement using Multisizer 3. (1) The software is set to graph/% by number so that the chart of measurement results is expressed in terms of percent by number. (2) A check mark is placed at a mark "<" in the particle size setting area on the "Format/Particle Size/Particle Size Statistics screen (in Japanese)", and "4" is input in the particle size input area below the check mark. (3) Thus, the value in the area where "<4 μm" is shown on the "Analysis/Number Statistic Value (Arithmetic Mean) screen (in Japanese)" represents the percentage of the number of particles of 4.0 μm or less in size in the toner.

Calculation of Amount of Coarse Powder

The amount of the coarse powder in the toner on a volume basis (percent by volume) is calculated as below. For example, for obtaining the amount on a volume basis (percent by volume) of particles of 10.0 μm or more in the toner, the following procedure is performed after the above-described measurement using Multisizer 3. (1) The software is set to graph/% by volume so that the chart of measurement results is expressed in terms of percent by volume. (2) A check mark is placed at a mark ">" in the particle size setting area on the "Format/Particle Size/Particle Size Statistics screen (in Japanese)", and "10" is input in the particle size input area below the check mark. (3) Thus, the value in the area where ">10 μm" is shown on the "Analysis/Number Statistic Value (Arithmetic Mean) screen (in Japanese)" represents the percentage of the volume of particles of 10.0 μm or less in size in the toner.

Calculation of Amount of Coarse Powder

The invention will be further described in detail with reference to Examples. The invention is not however limited to the examples.

Preparation of Porous Magnetic Particles 1

Step 1 (weighing and mixing)

$Fe_2O_3$: 68.3% by mass $MnCO_3$: 28.5% by mass $Mg(OH)_2$: 2.0% by mass $SrCO_3$: 1.2% by mass The above ferrite raw materials were weighed, and 20 parts by mass of water was added to 80 parts by mass of the mixture of the ferrite raw materials. Then, the materials were wet-mixed for 3 hours in a ball mill with zirconia beads of 10 mm in diameter, thus yielding a slurry. The solid content of the slurry was 80% by mass.

Step 2 (Calcination)

The slurry was dried with a spray dryer (manufactured by Ohkawara Kakohki), and was then calcined at a temperature of 1,050° C. for 3.0 hours in a nitrogen atmosphere (oxygen concentration: 1.0% by volume) in a batch-type electric furnace, thus yielding a calcined ferrite.

Step 3 (Pulverization)

The calcined ferrite was pulverized to a particle size of about 0.5 mm with a crusher. Then, water was added to the ferrite to yield a slurry. The solid content of the slurry was 70% by mass. The particles of the slurry were pulverized for 3 hours in a wet ball mill with ⅛ inch stainless beads. The resulting slurry was further pulverized for 4 hours in a wet bead mill with zirconia beads of 1 mm in diameter. The volume-based median particle size (D50) of the resulting slurry of the calcined ferrite was 1.3 μm.

Step 4 (Granulation)

To 100 parts by mass of the slurry of the calcined ferrite, 1.0 part by mass of poly(ammonium carboxylate) as a dispersant and 1.5 parts by mass of polyvinyl alcohol as a binder were added. The mixture was dried and granulated into spherical particles with a spray dryer (manufactured by Ohkawara Kakohki). The particle size of the resulting granulated material was adjusted, and then the organic substances such as the dispersant and the binder were removed by heating at 700° C. for 2 hours, using a rotary electric furnace.

Step 5 (Firing)

The material was fired in a nitrogen atmosphere (oxygen concentration: 0.8% by volume) for 4 hours at a constant temperature of 1,100° C., which was set from room temperature over a period of 2 hours. Then, the temperature was reduced to 60° C. over a period of 8 hours, and the nitrogen atmosphere was returned to the atmospheric air. The material was taken out at a temperature of 40° C.

Step 6 (Screening)

After aggregate particles were crushed, coarse particles were removed through a sieve having openings of 150 μm, and subsequently fine powder was removed by air classification. Furthermore, the resulting particles were subjected to magnetic separation to remove particles having low magnetic forces, thus yielding porous magnetic particles 1. The porous magnetic particles 1, which were porous, had the following composition:

$$(MnO)_a(MgO)_b(SrO)_c(Fe_2O_3)_f$$

where a=0.35, b=0.04, c=0.01 and f=0.60.

For porous magnetic particles 1, Table 1 shows the conditions in the steps of the process of the preparation thereof; Table 2 shows the physical properties thereof; and Table 3 shows the composition thereof including the proportions of the materials.

Preparation of Porous Magnetic Particles 2 to 13

Porous magnetic particles 2 to 13 were prepared in the same manner as porous magnetic particles 1, except that each step of the process was performed under the conditions shown in Table 1.

For porous magnetic particles 2 to 13, Table 1 shows the conditions in the steps of the process of the preparation thereof; Table 2 shows the physical properties thereof; and Table 3 shows the composition thereof including the proportions of the materials.

TABLE 1

| Porous magnetic particles No. | Step 2 Calcination Temp. (° C.) | Step 2 Calcination Time (h) | Step 3 Pulverization Time of wet pulverization in ball mill (h) | Step 3 Pulverization Time of wet pulverization in bead mill (h) | D50 (μm) | Step 4 Granulation Organic matter removal temperature (° C.) | Step 5 Firing Firing unit (Electric furnace) | Step 5 Firing Oxygen concentration (vol %) | Step 5 Firing Firing temp. (° C.) | Step 5 Firing Heating-up time (h) | Step 5 Firing Holding time (h) | Step 6 Screening Sieve openings (μm) |
|---|---|---|---|---|---|---|---|---|---|---|---|---|
| 1 | 1050 | 3.0 | 3.0 | 4.0 | 1.3 | 700 | Tunnel type | 0.8 | 1100 | 2.0 | 4.0 | 150 |
| 2 | 1050 | 3.0 | 3.0 | 5.0 | 1.2 | 700 | Tunnel type | 0.9 | 1150 | 1.5 | 4.5 | 150 |
| 3 | 1050 | 2.0 | 2.0 | 3.0 | 1.8 | 700 | Tunnel type | 0.9 | 1020 | 2.4 | 3.8 | 150 |
| 4 | 1000 | 3.0 | 4.0 | 5.0 | 1.1 | 700 | Tunnel type | 0.9 | 1150 | 1.5 | 4.5 | 150 |
| 5 | 1050 | 2.0 | 2.0 | 2.0 | 2.5 | 650 | Tunnel type | 1.0 | 1020 | 2.6 | 4.0 | 150 |
| 6 | 1050 | 3.0 | 3.0 | 4.0 | 1.2 | 700 | Tunnel type | 1.0 | 1050 | 2.0 | 4.0 | 150 |
| 7 | 1050 | 2.0 | 2.0 | 3.0 | 2.1 | 700 | Tunnel type | 0.8 | 1080 | 1.5 | 4.5 | 150 |
| 8 | 1050 | 3.0 | 4.0 | 5.0 | 1.0 | 700 | Tunnel type | 0.9 | 1150 | 1.5 | 4.0 | 150 |
| 9 | 1000 | 2.0 | 2.5 | 3.0 | 2.2 | 650 | Tunnel type | 0.9 | 1020 | 2.7 | 4.2 | 150 |
| 10 | 1000 | 2.0 | 2.0 | 3.0 | 2.1 | 650 | Tunnel type | 0.7 | 1080 | 1.5 | 4.0 | 150 |
| 11 | 1050 | 3.0 | 3.0 | 5.5 | 1.0 | 700 | Tunnel type | 1.0 | 1150 | 1.5 | 5.0 | 150 |
| 12 | 1050 | 3.0 | 3.0 | 4.0 | 1.3 | 700 | Tunnel type | 0.7 | 1110 | 2.0 | 4.0 | 150 |
| 13 | 1050 | 3.0 | 3.0 | 4.0 | 1.3 | 700 | Tunnel type | 1.1 | 1100 | 2.0 | 4.0 | 150 |

TABLE 2

| | D50 (μm) | Specific resistance at 300 V/cm (Ω · cm) | Breakdown point (V/cm) | Mercury intrusion method: Peak pore size (μm) | Mercury intrusion method: Pore volume ($mm^3/g$) |
|---|---|---|---|---|---|
| Porous magnetic particles 1 | 37.2 | $4.5 \times 10^7$ | 2500 | 0.62 | 64 |
| Porous magnetic particles 2 | 37.7 | $3.5 \times 10^7$ | 2000 | 0.15 | 23 |
| Porous magnetic particles 3 | 45.0 | $2.1 \times 10^7$ | 1750 | 0.98 | 90 |
| Porous magnetic particles 4 | 33.1 | $5.7 \times 10^7$ | 4000 | 0.13 | 25 |
| Porous magnetic particles 5 | 35.4 | $6.2 \times 10^7$ | 5000 | 1.04 | 96 |
| Porous magnetic particles 6 | 41.0 | $7.5 \times 10^7$ | 8000 | 0.50 | 20 |
| Porous magnetic particles 7 | 37.4 | $1.9 \times 10^7$ | 1500 | 0.87 | 99 |
| Porous magnetic particles 8 | 39.1 | $3.9 \times 10^7$ | 2200 | 0.45 | 18 |
| Porous magnetic particles 9 | 36.7 | $6.7 \times 10^7$ | 6000 | 0.93 | 105 |
| Porous magnetic particles 10 | 42.9 | $1.1 \times 10^7$ | 1200 | 1.00 | 100 |
| Porous magnetic particles 11 | 45.0 | $9.8 \times 10^7$ | 9000 | 0.15 | 20 |
| Porous magnetic particles 12 | 38.0 | $8.7 \times 10^6$ | 900 | 0.65 | 61 |
| Porous magnetic particles 13 | 39.4 | $1.2 \times 10^8$ | 10500 | 0.73 | 72 |

TABLE 3

| | Constituent (mass %): $Fe_2O_3$ | $MnCO_3$ | $Mg(OH)_2$ | $SrCO_3$ | Proportion a/b/c/d |
|---|---|---|---|---|---|
| Porous magnetic particles 1 | 68.3 | 28.5 | 2 | 1.2 | 0.35/0.04/0.01/0.60 |
| Porous magnetic particles 2 | 58 | 37.6 | 3.3 | 1.1 | 0.45/0.04/0.01/0.50 |
| Porous magnetic particles 3 | 73.4 | 25.3 | 0.4 | 0.9 | 0.26/0.01/0.01/0.72 |
| Porous magnetic particles 4 | 62 | 31.4 | 1.3 | 5.3 | 0.38/0.03/0.05/0.54 |
| Porous magnetic particles 5 | 58.5 | 39.6 | 0.8 | 1.1 | 0.47/0.02/0.01/0.50 |
| Porous magnetic particles 6 | 65.2 | 29.8 | 3.9 | 1.1 | 0.35/0.09/0.01/0.55 |

Preparation of Magnetic Carriers 1 to 18 and 20 to 26

Step 1 (Resin Filling)

An agitator (universal agitator NDMV, manufactured by Dalton) charged with 100 parts by mass of porous magnetic particles 1 was kept at a temperature of 60° C. Nitrogen was introduced into the agitator while the pressure was being reduced to 2.3 kPa. Then, resin solution 1 shown in Table 4 was dropped to porous magnetic particles 1. The amount of the resin solution dropped was adjusted to 5.0 parts by mass, in terms of solid content, relative to 100 parts by mass of the porous magnetic particles.

After the completion of dropping, agitation was continued for another two hours. Then, the sample was heated to 70° C., and the solvent was removed under reduced pressure. Thus, the pores of porous magnetic particles 1 were filled with a resin composition produced from resin solution 1.

After cooling, the resulting resin-filled magnetic core particles were placed in an agitator (Drum Mixer UD-AT, manufactured by Sugiyama Heavy Industrial) including a rotatable mixing container with a spiral blade, and were heated in a nitrogen atmosphere to a temperature of 220° C., to which the agitator was set, at a heating rate of 2° C./minutes. The sample was heated and agitated to cure the resin at that temperature for 1.0 hour, and further agitated at 200° C. for 1.0 hour.

After cooling to room temperature, ferrite particles filled with the cured resin were taken out, and nonmagnetic matter was removed with a magnetic separator. Furthermore, coarse particles were removed through a vibration sieve to yield resin-filled magnetic core particles.

Step 2 (Resin Coating)

Resin solution 3 shown in Table 4 was placed in a planetary mixer (Nauta Mixer VN, manufactured by Hosokawa Micron) charged with the resin-filled magnetic core particles, kept under reduced pressure (1.5 kPa) at 60° C. The proportion of resin solution 3 in terms of solid content was 2.0 parts by mass relative to 100 parts by mass of the porous magnetic particles. In this instance, ⅓ of the entirety of the resin solution was first introduced to the mixer, and removal of the solvent and application of the resin solution were performed for 20 minutes. Subsequently, another ⅓ of the entirety of the resin solution was introduced to the mixer, and removal of the solvent and application of the resin solution were performed for 20 minutes. Then, the rest (⅓) of the resin solution was further added, and removal of the solvent and application of the resin solution were performed for 20 minutes.

The resulting magnetic carrier, coated with the coating resin composition, was placed in an agitator (Drum Mixer UD-AT, manufactured by Sugiyama Heavy Industrial) including a rotatable mixing container with a spiral blade. The magnetic carrier was heated for 2 hours in a nitrogen atmosphere at a temperature of 120° C. while the mixing container was being rotated at a rate of 10 revolutions per minutes. The resulting magnetic carrier 1 was screened for low-magnetic-force particles by magnetic separation. After being subjected to separation through a sieve having openings of 150 μm, the magnetic carrier was classified with an air classifier. Thus magnetic carrier 1 having a volume-based median particle size (D50) of 38.6 μm was produced. For magnetic carrier 1, Tables 5 and 6 show the conditions in the steps of the process of the preparation thereof; and Table 7 shows the physical properties thereof.

Furthermore, magnetic carriers 2 to 18 and 20 to 26 were prepared under the conditions shown in Tables 5 and 6. The physical properties of these carriers are shown in Table 7. For magnetic carrier 26, the step of coating was performed as below.

Dry Coating of Magnetic Carrier 26

An agitator, Nibbler (manufactured by Hosokawa Micron), was charged with 100 parts by mass of porous magnetic particles 12 and 5.0 parts by mass of the solid resin of resin solution 2, prepared by removing only the solvent therefrom, and pulverizing the solid resin to a weight average particle size of 50 μm. The materials were premixed for 2 minutes at an agitation speed at which the speed of the extreme end of the agitation member was 1 m/s. Then, coating was performed for 15 minutes while the agitation speed was adjusted to 10 m/s, and thus particles of magnetic carrier 26 were produced. The resulting magnetic carrier 26 was screened for low-magnetic-force particles by magnetic separation. After being subjected to separation through a sieve having openings of 150 μm, the particles were classified with an air classifier to yield magnetic carrier 26 having a volume average median particle size (D50) of 41.0 μm. For magnetic carrier 26, Tables 5 and 6 show the conditions in the steps of the process of the preparation thereof; and Table 7 shows the physical properties thereof.

TABLE 4

| Resin | Resin | | Solvent | | Additive | |
|---|---|---|---|---|---|---|
| solution No. | Material | Content (mass %) | Material | Content (mass %) | Material | Content (mass %) |
| Solution 1 | SR2410 (solid content: 20%) Dow Corning Toray | 50.0 | Toluene | 49.5 | γ-aminopropyl triethoxysilane | 0.5 |
| Solution 2 | Poly(methyl methacrylate) polymer (Solid content: 40%) Weight average molecular weight (Mw): 85,000 | 50.0 | Toluene | 50.0 | — | — |
| Solution 3 | Cyclohexyl methacrylate/ Mw 5000 methyl methacrylate macromonomer/ methyl methacrylate copolymer (Solid content: 40%) | 50.0 | Toluene | 46.0 | Melamine/ formaldehyde condensation product (Epostar S6, Nippon Shokubai) | 3.0 |
| | | | | | Carbon black (#25, Mitsubishi Chemical) | 1.0 |

TABLE 5

| | | Resin filling | | | | | | |
|---|---|---|---|---|---|---|---|---|
| Carrier No. | Porous magnetic particles No. | Resin solution | Solid content to 100 parts by mass of Porous magnetic particles (parts by mass) | Stirring time after dropping (h) | Temperature of agitator (° C.) | Stirring time (h) | Holding temperature (° C.) | Holding time (h) |
| 1 | 1 | 1 | 5.0 | 2.0 | 220 | 1.0 | 200 | 1.0 |
| 2 | 1 | 1 | 5.0 | 2.0 | 220 | 1.0 | 200 | 1.0 |
| 3 | 1 | 1 | 5.0 | 2.0 | 220 | 1.0 | 200 | 1.0 |
| 4 | 1 | 1 | 5.0 | 2.0 | 220 | 1.0 | 200 | 1.0 |
| 5 | 1 | 1 | 5.0 | 2.0 | 220 | 1.0 | 200 | 1.0 |
| 6 | 1 | 1 | 1.0 | 1.5 | 220 | 1.0 | 200 | 1.0 |
| 7 | 1 | 1 | 5.5 | 2.2 | 220 | 1.0 | 200 | 1.0 |
| 8 | 1 | 1 | 0.8 | 1.5 | 220 | 1.0 | 200 | 1.0 |
| 9 | 1 | 1 | 6.0 | 2.5 | 220 | 1.0 | 200 | 1.0 |
| 10 | 2 | 1 | 5.0 | 2.0 | 220 | 1.0 | 200 | 1.0 |
| 11 | 3 | 1 | 5.0 | 2.0 | 220 | 1.0 | 200 | 1.0 |
| 12 | 4 | 1 | 3.0 | 2.0 | 220 | 1.0 | 200 | 1.0 |
| 13 | 5 | 1 | 5.0 | 2.0 | 220 | 1.0 | 200 | 1.0 |
| 14 | 6 | 1 | 5.0 | 2.0 | 220 | 1.0 | 200 | 1.0 |
| 15 | 7 | 1 | 5.0 | 2.0 | 220 | 1.0 | 200 | 1.0 |
| 16 | 8 | 1 | 5.0 | 2.0 | 220 | 1.0 | 200 | 1.0 |
| 17 | 9 | 1 | 5.0 | 2.0 | 220 | 1.0 | 200 | 1.0 |
| 18 | 10 | 1 | 1.0 | 1.5 | 220 | 1.0 | 200 | 1.0 |
| 20 | 1 | 1 | 5.0 | 2.0 | 220 | 1.0 | 200 | 1.0 |
| 21 | 1 | 2 | 5.0 | 2.0 | 100 | 1.0 | 100 | 2.0 |
| 22 | 1 | 2 | 5.0 | 2.0 | 100 | 1.0 | 100 | 2.0 |
| 23 | 12 | 1 | 5.0 | 2.0 | 220 | 1.0 | 200 | 1.0 |
| 24 | 12 | 1 | 12.0 | 5.0 | 220 | 1.0 | 200 | 1.0 |
| 25 | 13 | 1 | 5.0 | 2.0 | 220 | 1.0 | 200 | 1.0 |
| 26 | 12 | — | — | — | — | — | — | — |

TABLE 6

| Carrier No. | Porous magnetic particles No. | Coating: Resin solution | Coating: Solid content to 100 parts by mass of porous magnetic particles (parts by mass) | Coating: Coating process | Coating: Coating unit temperature (° C.) | Coating: Treating time (h) | Coating: Sieve openings (μm) |
|---|---|---|---|---|---|---|---|
| 1 | 1 | 3 | 2.0 | Wet | 120 | 2.0 | 150 |
| 2 | 1 | 3 | 1.0 | Wet | 120 | 2.0 | 150 |
| 3 | 1 | 3 | 3.0 | Wet | 120 | 2.0 | 150 |
| 4 | 1 | 3 | 0.8 | Wet | 120 | 2.0 | 150 |
| 5 | 1 | 3 | 3.5 | Wet | 120 | 2.0 | 150 |
| 6 | 1 | 3 | 2.0 | Wet | 120 | 2.0 | 150 |
| 7 | 1 | 3 | 2.0 | Wet | 120 | 2.0 | 150 |
| 8 | 1 | 3 | 2.0 | Wet | 120 | 2.0 | 150 |
| 9 | 1 | 3 | 2.0 | Wet | 120 | 2.0 | 150 |
| 10 | 2 | 3 | 2.0 | Wet | 120 | 2.0 | 150 |
| 11 | 3 | 3 | 2.0 | Wet | 120 | 2.0 | 150 |
| 12 | 4 | 3 | 2.0 | Wet | 120 | 2.0 | 150 |
| 13 | 5 | 3 | 2.0 | Wet | 120 | 2.0 | 150 |
| 14 | 6 | 3 | 2.0 | Wet | 120 | 2.0 | 250 |
| 15 | 7 | 3 | 2.0 | Wet | 120 | 2.0 | 150 |
| 16 | 8 | 3 | 2.0 | Wet | 120 | 2.0 | 250 |
| 17 | 9 | 3 | 2.0 | Wet | 120 | 2.0 | 150 |
| 18 | 10 | 3 | 1.0 | Wet | 120 | 2.0 | 250 |
| 20 | 1 | 1 | 2.0 | Wet | 200 | 2.0 | 150 |
| 21 | 1 | 3 | 2.0 | Wet | 120 | 2.0 | 150 |
| 22 | 1 | 1 | 2.0 | Wet | 200 | 2.0 | 150 |
| 23 | 12 | 3 | 2.0 | Wet | 120 | 2.0 | 150 |
| 24 | 12 | 3 | 2.0 | Wet | 120 | 2.0 | 150 |
| 25 | 13 | 3 | 2.0 | Wet | 120 | 2.0 | 150 |
| 26 | 12 | 2 | 5.0 | Dry | — | — | 150 |

TABLE 7

| Carrier No. | Porous magnetic particles No. | D50 (μm) | Current (μA) | Specific resistance at 1000 V/cm (Ω · cm) | Specific resistance at 2000 V/cm (Ω · cm) | Breakdown point (V/m) | Resistance retention rate (%) |
|---|---|---|---|---|---|---|---|
| 1 | 1 | 38.6 | 27.0 | $8.1 \times 10^7$ | $6.6 \times 10^7$ | 5000 | 90~95 |
| 2 | 1 | 39.1 | 30.0 | $6.5 \times 10^7$ | $4.3 \times 10^7$ | 4500 | 88~91 |
| 3 | 1 | 39.5 | 22.4 | $9.3 \times 10^7$ | $7.5 \times 10^7$ | 6200 | 90~94 |
| 4 | 1 | 38.8 | 31.7 | $5.3 \times 10^7$ | $2.5 \times 10^7$ | 3500 | 87~91 |
| 5 | 1 | 40.1 | 15.4 | $2.1 \times 10^8$ | $1.2 \times 10^8$ | 10500 | 91~96 |
| 6 | 1 | 40.3 | 30.7 | $6.3 \times 10^7$ | $4.0 \times 10^7$ | 4000 | 89~92 |
| 7 | 1 | 39.9 | 21.2 | $1.1 \times 10^8$ | $9.3 \times 10^7$ | 7500 | 90~94 |
| 8 | 1 | 38.6 | 33.0 | $4.5 \times 10^7$ | $2.0 \times 10^7$ | 3000 | 82~87 |
| 9 | 1 | 38.9 | 13.0 | $4.3 \times 10^8$ | $2.6 \times 10^8$ | 11500 | 90~95 |
| 10 | 2 | 39.1 | 21.8 | $9.6 \times 10^7$ | $8.0 \times 10^7$ | 7000 | 90~94 |
| 11 | 3 | 46.1 | 48.9 | $2.1 \times 10^7$ | $1.2 \times 10^7$ | 1500 | 81~86 |
| 12 | 4 | 35.0 | 30.9 | $6.1 \times 10^7$ | $5.1 \times 10^7$ | 3750 | 89~92 |
| 13 | 5 | 36.9 | 29.4 | $7.2 \times 10^7$ | $6.0 \times 10^7$ | 4600 | 89~93 |
| 14 | 6 | 42.8 | 26.1 | $8.7 \times 10^7$ | $6.9 \times 10^7$ | 5300 | 90~95 |
| 15 | 7 | 40.0 | 40.0 | $3.1 \times 10^7$ | $1.8 \times 10^7$ | 1950 | 82~88 |
| 16 | 8 | 42.3 | 32.3 | $5.0 \times 10^7$ | $3.5 \times 10^7$ | 4000 | 90~93 |
| 17 | 9 | 38.1 | 23.0 | $9.2 \times 10^7$ | $7.1 \times 10^7$ | 9000 | 89~95 |
| 18 | 10 | 44.3 | 50.0 | $2.1 \times 10^7$ | $1.1 \times 10^7$ | 2000 | 83~91 |
| 20 | 1 | 38.1 | 29.3 | $7.2 \times 10^7$ | $5.6 \times 10^7$ | 4500 | 87~92 |
| 21 | 1 | 39.5 | 18.3 | $1.5 \times 10^8$ | $9.3 \times 10^7$ | 8000 | 88~93 |
| 22 | 1 | 40.0 | 21.9 | $9.6 \times 10^7$ | $7.7 \times 10^7$ | 7200 | 87~92 |
| 23 | 12 | 40.3 | 50.9 | $1.1 \times 10^7$ | $9.0 \times 10^5$ | 1500 | 0~41 |
| 24 | 12 | 39.9 | 27.4 | $7.9 \times 10^7$ | $5.9 \times 10^7$ | 2500 | 0~47 |
| 25 | 13 | 41.2 | 5.1 | $2.3 \times 10^9$ | $1.2 \times 10^9$ | Not broken down | 85~91 |
| 26 | 12 | 41.0 | 21.1 | $1.1 \times 10^8$ | $9.0 \times 10^7$ | 3500 | 30~61 |

Preparation of Toner 1

Binder resin (polyester resin, Tg: 58° C., acid value: 15 mg KOH/g, hydroxyl value: 15 mg KOH/g, peak molecular weight: 5,800, number average molecular weight: 3,500, weight average molecular weight: 95,000): 100 parts by mass C.I. Pigment Blue 15:3: 4.5 parts by mass Aluminum 3,5-di-t-butylsalicylate compound: 0.5 part by mass Normal paraffin wax (melting point: 78° C.): 6.0 parts by mass The above materials were sufficiently mixed with a Henschel mixer (FM-75J, manufactured by Mitsui Mining). The mixture was kneaded in a twin screw kneader (PCM-30, manufactured by Ikegai) set at a temperature of 130° C., with a feed rate of 10 kg/h (temperature of the mixture during extrusion was about 150° C.). After being cooled, the resulting mixture was crushed with a hammer mill, and further pulverized to much lower particle sizes with a mechanical pulverizer (T-250, manufactured by Turbo Kogyo) at a feed rate of 15 kg/hour. Thus, particles were produced which had a weight average particle size of 5.5 μm, and included particles having a diameter of 4.0 μm or less in an amount of 55.6% by number and particles having a diameter of 10.0 μm or more in an amount of 0.8% by volume.

The resulting particles were classified for fine powder and coarse particles with a rotary classifier (TTSP100, manufactured by Hosokawa micron). Thus, cyan toner particles 1 were produced which had a weight average particle size of 6.4 μm, and included particles having a diameter of 4.0 μm or less in an amount of 25.8% by number and particles having a diameter of 10.0 μm or more in an amount of 2.5% by volume.

Furthermore, the following materials were introduced into a Henschel mixer (FM-75, manufactured by Nippon Coke) and mixed for 3 minutes with the rotational blade rotated at a peripheral speed of 35.0 m/s, thus yielding cyan toner 1 which was cyan toner particles having surfaces to which silica and titanium oxide were attached.

Cyan toner particles 1: 100 parts by mass

Silica: 3.5 parts by mass (prepared by surface treatment of silica particles produced by a sol-gel method with 1.5% by mass of hexamethyldisilazane, followed by classification so as to have a predetermined particle size distribution)

Titanium oxide: 0.5 part by mass (prepared by surface-treating metatitanic acid having an anatase crystallinity with an octylsilane compound)

Yellow toner particles 1, magenta toner particles 1, and black toner particles 1 were produced in the same manner as cyan toner particles 1, except that 7.0 parts by mass of C.I. Pigment Yellow 74, 6.3 parts by mass of C.I. Pigment Red 122, and 5.0 parts by mass of carbon black were used, respectively, instead of 4.5 parts by mass of C.I. Pigment Blue 15:3.

Then, silica and titanium oxide were added to the resulting particles in the same manner as in the case of cyan toner 1 to yield yellow toner 1, magenta toner 1 and black toner 1. The physical properties of the toners produced as above are shown in Table 8.

TABLE 8

| | Toner particle size | | |
|---|---|---|---|
| | Weight average particle size (μm) | Presence of 4.0 μm or less particles (% by number) | Presence of 10.0 μm or less particles (% by volume) |
| Cyan toner 1 | 6.4 | 25.8 | 2.5 |
| Yellow toner 1 | 6.3 | 26.2 | 2.4 |
| Magenta toner 1 | 6.3 | 25.9 | 2.5 |
| Black toner 1 | 6.7 | 24.6 | 2.6 |

EXAMPLE 1

To 91 parts by mass of magnetic carrier 1, 9 parts by mass of each toners 1 was separately added, and the materials were shaken in a shaker (YS-8D, produced by Yayoi) to yield 300 g of each of two-component developers. The shaking was performed for 2 minutes at a stroke of 200 rpm.

For preparing replenishing developers, 90 parts by mass of each toner 1 was separately added to 10 parts by mass of magnetic carrier 1, and the materials were mixed for 5 minutes with a V-blender at room temperature and humidity (23° C., 50% RH).

The two-component developers and the replenishing developers were evaluated as below. A color copy machine, modified from imageRUNNER ADVANCE C9075 PRO manufacture by Canon, was used as an image forming apparatus. The developing units for each color of the image forming apparatus were charged separately with a two-component developer of the corresponding color, and replenishing developer containers each containing the corresponding replenishing developer were mounted to the image forming apparatus.

Evaluation was performed in an environment at a temperature of 23° C. and a humidity of 5 RH % (hereinafter expressed as N/L environment) and an environment at a temperature of 30° C. and a humidity pf 80 RH % (hereinafter expressed as H/H environment). For evaluation in the N/L environment, an FFH output chart with an image ratio of 1% was used. For evaluation in the H/H environment, an FFH output chart with an image ratio of 40% was used. FFH refers to a value of 256 gray-scale expressed in hexadecimal notation; 00h represents the first scale (flank) of the 256 scales; and FFH represents the 256th scale (solid) of the 256 scales.

The number of output image sheets was varied depending on the evaluation.

Conditions:

Paper sheet: paper sheet for laser beam printer, CS-814 (81.4 g/m$^2$, available from Canon Marketing Japan) Image forming speed: The apparatus was modified so that full color images could be output at a speed of 80 sheets (A4 size) per minutes.

Developing conditions: The apparatus was modified so that development contrast could be arbitrarily varied without automatic correction by the apparatus.

The apparatus was also modified so that the peak-to-peak voltage (Vpp) of the alternating electric field could be varied from 0.7 kV to 1.8 kV in increments of 0.1 kV at a frequency of 2.0 kHz.

The apparatus was also modified so that single-color images with any one of the colors could be formed.

Evaluations for each property were performed as below.

(1) Blank Dots

In the N/L environment, charts in which halftone horizontal bands (30H, width: 10 mm) and black solid horizontal bands (FFH, width: 10 mm) were alternately arranged in the conveying direction of the transfer paper were output at the initial stage and after continuously feeding 2,000 sheets. The images were read with a scanner and the image data were binarized. The luminance distribution (256 gray scales) of the binarized image in the conveying direction was prepared. In a changing region from a solid black portion to a halftone portion, the sum of differences between an original luminance of the halftone portion and the measured luminance was considered to be the blank dot level. The original luminance of the halftone portion equals to a luminance at a rear end of the halftone portion. The black dot level was evaluated according to the following criteria: Cyan single color images were evaluated.

A: less than 20

B: 20 or more and less than 30

C: 30 or more and less than 40

D: 40 or more and less than 50

E: 50 or more (2) Reduction in Graininess of Halftone Image

In the H/H environment, a sheet (A4 size) of a halftone image (30H) was printed at the initial stage and after durability test of outputting 50,000 sheets of images. For each image, the area of 1,000 dots was measured with a digital microscope VHX-500 (Wide lens zoom lens VH-Z100, manufactured by Keyence). The number average dot area (S) and the standard deviation (σ) of the dot area were calculated, and the dot reproduction index was calculated using the following equation. The dot reproduction index (I) was evaluated as the graininess of half tone images.

Dot reproduction index (I)=(σ/S)×100

The graininess was evaluated for cyan single color image according to the following criteria:

A: I<3.0

B: 3.01≤I<5.0

C: 5.01≤I<6.5

D: 6.5≤I<8.0

E: 8.0≤I (3) Developability after Durability Test

For evaluation of developability after durability test, the contrast voltage when the density of a cyan single color solid pattern came to 1.50 (reflection density) was measured with the initial peak-to-peak voltage (Vpp) fixed to 1.3 kV in the N/L environment.

Under the same conditions, the peak-to peak voltage (Vpp) was set to 1.3 kV after 20,000-sheet durability test, and the contrast voltage when the image density came to 1.50 was measured, and compared with the value measured in the initial stage. Cyan single color images were evaluated.

The reflection density was measured with a spectroscopic densitometer 500 series (manufactured by X-Rite).

Criteria of Developability

A: difference from initial stage was less than 40 V

B: difference from initial stage was 40 V or more and less than 60 V

C: difference from initial stage was 60 V or more and less than 80 V

D: difference from initial stage was 80 V or more and less than 100 V

E: difference from initial stage was 100 V or more (4) Carrier Adhesion after Durability Test In the N/L environment, the adhesion of the carrier was evaluated after image output durability test. A OOH image and an FFH image were output. The apparatus was turned off in the middle of outputting, and a transparent adhesive tape was brought into contact with the electrostatic latent image bearing member before being cleaned for sampling. Thus, the number of magnetic carrier particles attached to an area of 3 cm×3 cm of the electrostatic latent image bearing member was counted, and the number of magnetic carrier particles per square centimeter was calculated and evaluated according to the following criteria. Cyan single color images were evaluated.

A: 2 or more

B: 3 or more and 4 or less

C: 5 or more and 6 or less

D: 7 or more and 8 or less

E: 9 or more (5) Change in Tone after Durability Test

Patterns having the following densities were output at default setting in the N/L environment, immediately after feeding 2000 sheets, and the difference in tone from the initial stage was examined. The image densities of the patterns were measured with Color Reflection Densitometer X-Rite 404A. Cyan single color images were evaluated.

Pattern 1: 0.10 to 0.13

Pattern 2: 0.25 to 0.28

Pattern 3: 0.45 to 0.48

Pattern 4: 0.65 to 0.68

Pattern 5: 0.85 to 0.88

Pattern 6: 1.05 to 1.08

Pattern 7: 1.25 to 1.28

Pattern 8: 1.45 to 1.48

Evaluation criteria were as follows:

A: All the patterns satisfied the above density ranges.

B: One of the patterns had a density outside the above density ranges.

C: Two of the patterns had a density outside the above density ranges.

D: Three of the patterns had a density outside the above density ranges.

E: Four of the patterns had a density outside the above density ranges.

(6) Change in Color Tinge of Mixed Color

Changes in color tinge of red being a mixed color of yellow and magenta were examined. Before durability test, the development contrast was adjusted so that the reflection density of single color solid patterns on a sheet would be 1.5. Then, a red solid pattern formed in the N/L environment immediately after feeding 2,000 sheets and a red solid pattern formed in the H/H environment immediately after feeding 2,000 sheets were output, and the difference in color tinge between the environments was examined.

Measurement for Difference in Color Tinge

The difference in color tinge can be evaluated by measuring chromaticities a* and b* with SpectroScan Transmission (manufacture by GretagMacbeth). Exemplary measuring conditions were shown below:

Measuring Conditions

Observation light source: D50

Observation viewing angle: 2°

Density: DIN NB

White standard: Pap

Filter: none

In general, chromaticities a* and b* are values used in the L*a*b* colorimetric system which is a useful measure for expressing colors in a numerical form. a* and b* represent a hue in combination. Hue is a measure of tones of color, such as red, yellow, green, blue, and violet. a* and b* are each represents a direction of color: a* represents a red-green direction; and b* represents a yellow-blue direction. For the evaluation, the difference in color tinge (ΔC) was defined as below:

$$\Delta C=[\{(a^* \text{ of image formed in the } HH \text{ environment})-(a^* \text{ of image formed in the NL environment})\}^2+\{(b^* \text{ of image formed in the } HH \text{ environment})-(b^* \text{ of image formed in the } NL \text{ environment})^2\}]^{1/2}$$

Measurement was performed at 5 points randomly selected from images, and measurements were averaged. For evaluation, the a* and b* of solid patterns formed in the different environments were measured, and ΔC was calculated using the above equation.

A: 0≤ΔC<2.0

B: 2.0≤ΔC<3.5

C: 3.5≤ΔC<5.0

D: 5.0≤ΔC<6.5

E: 6.5≤ΔC (7) Evaluation of Flaws in Copy Machine Members

In the N/L environment, a A4-full size FFH image was output every 1000 sheets in a 50,000-sheet durability test, and it was examined whether or not flaws in copy machine members, such as white lines or spots, caused by scattering carrier particles, occurred.

Evaluation criteria are based on the number of sheets fed for durability at the time when two or more image defects, such as white lines or spot, occurred in A4-full size FFH images formed every 1,000 sheets, and are as follows. Cyan single color images were evaluated.

A: no image defects even after 50,000 sheets were fed.

B: An image defect occurred when 40,000 sheets or more were fed.

C: An image defect occurred when 30,000 sheets or more were fed.

D: An image defect occurred when 20,000 sheets or more were fed.

E: An image defect occurred when less than 20,000 sheets were fed.

(8) Evaluation of Resistance Retention Rate

Resistance retention rate was measure at an electric field intensity of 1000 V/cm according to the above-described method.

(9) Comprehensive Evaluation

The ratings of evaluations (1) to (7) were converted into numbers (A=5, B=4, C=3, D=2, and E=0), and total values were evaluated according to the following criteria.

A: 50 ore more and 46 or less

B: 45 or more and 39 or less

C: 38 or more and 30 or less

D: 29 or more and 20 or less

E: 19 or less, not allowable

Example 1 was evaluated to be excellent in each examination. The results are shown in Tables 9 to 11.

EXAMPLES 2 to 18 and 20 to 22
COMPARATIVE EXAMPLES 1 to 4

Two-component developers and replenishing developers were prepared in the same manner as in Example 1, except that magnetic carriers 2 to 18 and 20 to 26 were used. Evaluations were performed in the same manner as in Example 1, except that the developers prepared for each example were used. The results are shown in Tables 9 to 11.

TABLE 9

| | | Blank dot | | | | Graininess | | | | Developability after | |
|---|---|---|---|---|---|---|---|---|---|---|---|
| | | Initial | | After durability test | | | | After durability | | durability test | |
| | Carrier | Sum of | | Sum of | | Initial | | test | | Difference from | |
| | No. | differences | Rating | differences | Rating | (I) | Rating | (I) | Rating | initial (V) | Rating |
| Example 1 | 1 | 11 | A | 18 | A | 2.1 | A | 2.7 | A | 35 | A |
| Example 2 | 2 | 18 | A | 28 | B | 2.1 | A | 2.5 | A | 40 | B |
| Example 3 | 3 | 11 | A | 17 | A | 2.1 | A | 3.9 | B | 40 | B |
| Example 4 | 4 | 10 | A | 16 | A | 2.9 | A | 4.3 | B | 30 | A |
| Example 5 | 5 | 30 | C | 31 | C | 2.7 | A | 5.2 | C | 42 | B |
| Example 6 | 6 | 36 | C | 39 | C | 2.9 | A | 5.3 | C | 40 | B |
| Example 7 | 7 | 21 | B | 30 | C | 2.0 | A | 2.4 | A | 41 | B |
| Example 8 | 8 | 30 | C | 31 | C | 2.7 | A | 5.2 | C | 42 | B |
| Example 9 | 9 | 36 | C | 39 | C | 2.9 | A | 5.3 | C | 40 | B |
| Example 10 | 10 | 27 | B | 39 | C | 2.1 | A | 2.7 | A | 58 | B |
| Example 11 | 11 | 10 | A | 17 | A | 3.2 | B | 4.8 | B | 35 | A |
| Example 12 | 12 | 38 | C | 39 | C | 3.0 | B | 5.1 | C | 76 | C |
| Example 13 | 13 | 29 | B | 33 | C | 2.8 | A | 5.1 | C | 45 | B |
| Example 14 | 14 | 10 | A | 16 | A | 3.3 | B | 5.0 | C | 38 | A |
| Example 15 | 15 | 27 | B | 39 | C | 2.1 | A | 2.7 | A | 58 | B |
| Example 16 | 16 | 24 | B | 28 | B | 2.6 | A | 5.0 | C | 41 | B |
| Example 17 | 17 | 29 | B | 33 | C | 2.8 | A | 5.1 | C | 45 | B |
| Example 18 | 18 | 10 | A | 17 | A | 3.2 | B | 4.8 | B | 35 | A |
| Example 20 | 20 | 18 | A | 28 | B | 2.1 | A | 2.5 | A | 40 | B |
| Example 21 | 21 | 11 | A | 17 | A | 2.1 | A | 3.9 | B | 40 | B |
| Example 22 | 22 | 10 | A | 16 | A | 2.9 | A | 4.3 | B | 30 | A |
| Comparative Example 1 | 23 | 51 | E | 58 | E | 2.2 | A | 2.6 | A | 101 | E |
| Comparative Example 2 | 24 | 13 | A | 19 | A | 7.6 | D | 8.6 | E | 62 | C |
| Comparative Example 3 | 25 | 46 | D | 36 | C | 8.6 | E | 9.7 | E | 57 | B |
| Comparative Example 4 | 26 | 15 | A | 19 | A | 8.4 | E | 9.5 | E | 43 | B |

TABLE 10

| | Carrier adhesion after durability test | | | | Change in tone after durability test | | | | |
|---|---|---|---|---|---|---|---|---|---|
| | 00H image | | FFH image | | | | | Flaw in copy machine member | |
| | Number of carrier particles | Rating | Number of carrier particles | Rating | * Pattern No. of reject | Number of rejects | Rating | Number of defective sheets | Rating |
| Example 1 | 1 | A | 1 | A | — | 0 | A | — | A |
| Example 2 | 1 | A | 2 | A | — | 0 | A | — | A |
| Example 3 | 2 | A | 2 | A | — | 0 | A | — | A |
| Example 4 | 3 | B | 1 | A | — | 1 | A | — | A |
| Example 5 | 4 | B | 5 | C | 2, 3, 4 | 3 | C | — | A |
| Example 6 | 4 | B | 7 | D | 3, 4, 5, 6 | 4 | D | — | A |
| Example 7 | 4 | B | 3 | B | 6 | 1 | B | — | A |
| Example 8 | 4 | B | 5 | C | 2, 3, 4 | 3 | C | — | A |
| Example 9 | 4 | B | 7 | D | 3, 4, 5, 6 | 4 | D | — | A |
| Example 10 | 4 | B | 4 | B | 5, 6, 7 | 3 | C | 38000 | C |
| Example 11 | 1 | A | 2 | A | 2, 3 | 2 | C | 48000 | B |
| Example 12 | 4 | B | 4 | B | 2, 3, 4, 5 | 4 | D | 28000 | D |
| Example 13 | 7 | D | 4 | B | 2, 3 | 3 | C | 30000 | C |
| Example 14 | 3 | B | 2 | A | 2, 3, 4 | 3 | C | 42000 | B |
| Example 15 | 4 | B | 4 | B | 5, 6, 7 | 3 | C | 38000 | C |
| Example 16 | 6 | C | 3 | B | 4, 5, 6 | 3 | C | 35000 | C |
| Example 17 | 7 | D | 4 | B | 2, 3 | 3 | C | 30000 | C |
| Example 18 | 1 | A | 2 | A | 2, 3 | 2 | C | 48000 | B |
| Example 20 | 1 | A | 2 | A | — | 0 | A | — | A |
| Example 21 | 2 | A | 2 | A | — | 0 | A | — | A |
| Example 22 | 3 | B | 1 | A | — | 1 | A | — | A |
| Comparative Example 1 | 7 | D | 10 | E | 2, 3, 5, 6, 7, 8 | 6 | E | — | A |
| Comparative Example 2 | 8 | D | 6 | C | 2, 5, 6, 7 | 4 | D | — | A |
| Comparative Example 3 | 9 | E | 8 | D | 3, 4, 5, 6, 7, 8 | 6 | E | — | A |
| Comparative Example 4 | 9 | E | 6 | C | 2, 5 | 2 | C | — | A |

* Shows pattern Nos. whose tone was varied.

TABLE 11

| | Red hue (a* b*) | | | | | | | | |
|---|---|---|---|---|---|---|---|---|---|
| | after HH durability test | | After NL durability | | Degree of changes | | Resistance retention rate | Comprehensive evaluation | |
| | a* | b* | a* | b* | ΔC | Rating | (%) | Rating index | Rating |
| Example 1 | 44.98 | 37.46 | 44.25 | 36.31 | 1.36 | A | 91 | 50 | A |
| Example 2 | 44.67 | 36.57 | 43.05 | 35.85 | 1.77 | A | 90 | 49 | A |
| Example 3 | 44.67 | 36.57 | 43.05 | 35.85 | 1.77 | A | 91 | 48 | A |
| Example 4 | 44.85 | 36.83 | 43.59 | 35.41 | 1.90 | A | 89 | 48 | A |
| Example 5 | 44.55 | 36.95 | 42.81 | 34.24 | 3.22 | B | 91 | 37 | C |
| Example 6 | 44.79 | 38.04 | 41.46 | 35.44 | 4.22 | C | 90 | 34 | C |
| Example 7 | 43.58 | 38.03 | 42.22 | 37.15 | 1.62 | A | 88 | 43 | B |
| Example 8 | 44.55 | 36.95 | 42.81 | 34.24 | 3.22 | B | 89 | 37 | C |
| Example 9 | 44.79 | 38.04 | 41.46 | 35.44 | 4.22 | C | 92 | 34 | C |
| Example 10 | 45.21 | 38.93 | 43.69 | 36.44 | 2.92 | B | 91 | 39 | B |
| Example 11 | 44.90 | 38.47 | 43.57 | 37.36 | 1.73 | A | 90 | 45 | B |
| Example 12 | 47.22 | 38.54 | 43.21 | 35.30 | 5.16 | D | 89 | 30 | C |
| Example 13 | 46.11 | 36.95 | 43.48 | 33.98 | 3.97 | C | 91 | 34 | C |
| Example 14 | 44.81 | 38.14 | 44.21 | 36.24 | 1.99 | A | 93 | 43 | B |
| Example 15 | 45.21 | 38.93 | 43.69 | 36.44 | 2.92 | B | 90 | 39 | B |
| Example 16 | 45.46 | 39.01 | 43.74 | 36.24 | 3.26 | B | 88 | 37 | C |
| Example 17 | 46.11 | 36.95 | 43.48 | 33.98 | 3.97 | C | 89 | 34 | C |
| Example 18 | 44.90 | 38.47 | 43.57 | 37.36 | 1.73 | A | 93 | 45 | B |
| Example 20 | 44.67 | 36.57 | 43.05 | 35.85 | 1.77 | A | 90 | 49 | A |
| Example 21 | 44.67 | 36.57 | 43.05 | 35.85 | 1.77 | A | 91 | 48 | A |
| Example 22 | 44.85 | 36.83 | 43.59 | 35.41 | 1.90 | A | 91 | 48 | A |
| Comparative Example 1 | 44.75 | 36.82 | 38.57 | 33.78 | 6.89 | E | 61 | 17 | E |

TABLE 11-continued

| | Red hue (a* b*) | | | | | | | | |
|---|---|---|---|---|---|---|---|---|---|
| | after HH durability test | | After NL durability | | Degree of changes | | Resistance retention rate | Comprehensive evaluation | |
| | a* | b* | a* | b* | ΔC | Rating | (%) | Rating index | Rating |
| Comparative Example 2 | 47.75 | 38.74 | 43.91 | 34.18 | 5.96 | D | 48 | 29 | D |
| Comparative Example 3 | 45.25 | 37.03 | 40.19 | 32.78 | 6.61 | E | 95 | 16 | E |
| Comparative Example 4 | 46.40 | 36.85 | 43.22 | 34.01 | 4.26 | C | 47 | 28 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-113776, filed May 30, 2013 which is hereby incorporated by reference herein in its entirety.

What is claimed is:

1. A magnetic carrier comprising:

resin-filled magnetic core particles containing porous magnetic particles having pores therein and a resin present in the pores; and resin coating layers coating the surfaces of the resin-filled magnetic core particles, the resin coating layer including a coating resin, wherein:

(i) the porous magnetic particles are made of Mn-Mg-Sr ferrite;

(ii) the porous magnetic particles have a specific resistance in the range of $1.0\times10^7$ Ω·cm to $1.0\times10^8$ Ω·cm at an electric field intensity of 300 V/cm; and (iii) the porous magnetic particles have an electrical breakdown at electric field intensity in the range of 1,000 V/cm to 10,000 V/cm, and wherein:

(iv) the magnetic carrier has a specific resistance in the range of $1.0\times10^7$ Ω·cm to $1.0\times10^9$ Ω·cm at an electric field intensity of 2,000 V/cm;

(v) the magnetic carrier has a specific resistance in the range of $2.0\times10^7$ Ω·cm to $2.0\times10^9$ Ω·cm at an electric field intensity of 1,000 V/cm;

(vi) the magnetic carrier has an electrical breakdown at electric field intensity in the range of 1,000 V/cm to 15,000 V/cm;

(vii) the magnetic carrier exhibits a current in the range of 8.0 μA to 50.0 μA when a voltage of 500 V is applied thereto; and (viii) the resin content in the resin-filled magnetic core particles is in the range of 1.0 to 5.5 parts by mass relative to 100 parts by mass of the porous magnetic particles.

2. The magnetic carrier according to claim 1, wherein the porous magnetic particles have a pore volume obtained by integrating the differential pore volume thereof in the range of 20 $mm^3/g$ to 100 $mm^3/g$ in a pore size distribution in the range of 0.1 μm to 3.0 μm.

3. The magnetic carrier according to claim 1, wherein the porous magnetic particles have a peak pore size, with which the differential pore volume is largest, in the range of 0.15 μm to 1.00 μm in a pore size distribution in the range of 0.1 μm to 3.0 μm.

4. The magnetic carrier according to claim 1, wherein the proportion of the coating resin is in the range of 1.0 to 3.0 parts by mass relative to 100 parts by mass of the porous magnetic particles.

5. A two-component developer comprising:

a toner containing a binder resin, a coloring agent, and a release agent; and the magnetic carrier as set forth in claim 1.

6. A replenishing developer used in a process of two-component development including charging an electrostatic latent image bearing member, forming an electrostatic latent image on the surface of the electrostatic latent image bearing member, developing the electrostatic latent image into a toner image with a two-component developer in a developing unit, transferring the toner image to a transfer medium using or not using an intermediate transfer medium, and fixing the transferred toner image to the transfer medium, the replenishing developer comprising:

a replenishing magnetic carrier being the magnetic carrier as set forth in claim 1; and a toner in a mass ratio in the range of 2 to 50 to the replenishing magnetic carrier, the toner containing a binder resin, a coloring agent, and a release agent, wherein in the process of two-component development, the replenishing developer is supplied to the developing unit according to decrease in the toner concentration in the two-component developer in the developing unit, and an excess magnetic carrier is discharged from the developing unit as required.

7. An image forming method comprising:

charging an electrostatic latent image bearing member;

forming an electrostatic latent image on the surface of the electrostatic latent image bearing member;

developing the electrostatic latent image into a toner image with the two-component developer as set forth in claim 5 in a developing unit;

transferring the toner image to a transfer medium using or not using an intermediate transfer medium; and fixing the transferred toner image to the transfer medium.

8. An image forming method comprising:

charging an electrostatic latent image bearing member;

forming an electrostatic latent image on the surface of the electrostatic latent image bearing member;

developing the electrostatic latent image into a toner image with a two-component developer in a developing unit, the two-component developer containing a magnetic carrier and a toner;

transferring the toner image to a transfer medium using or not using an intermediate transfer medium;

fixing the toner image to the transfer medium, and supplying a replenishing developer to the developing unit according to decrease in the toner concentration of the two-component developer in the developing unit and discharging an excess magnetic carrier from the developing unit, as required, the replenishing developer containing a replenishing magnetic carrier being the magnetic carrier as set forth in claim 1, and a toner in a mass ratio in the range of 2 to 50 to the replenishing magnetic carrier, the toner containing a binder resin, a coloring agent, and a release agent.

* * * * *